US012239278B2

(12) United States Patent
Cipriani et al.

(10) Patent No.: US 12,239,278 B2
(45) Date of Patent: Mar. 4, 2025

(54) VESSEL RINSING APPARATUS, DRAIN RECEPTACLE, INTERCHANGEABLE NOZZLE ASSEMBLY, AND FAUCET SYSTEM INCLUDING SAME

(71) Applicant: Delta Faucet Company, Indianapolis, IN (US)

(72) Inventors: Mark Cipriani, Carmel, IN (US); Todd Huffington, Avon, IN (US); Alfred Nelson, Westfield, IN (US); Michael Veros, Carmel, IN (US); Kyle Davidson, Noblesville, IN (US); Kurt Thomas, Indianapolis, IN (US); Jeffrey Moore, Frankfort, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 18/494,351

(22) Filed: Oct. 25, 2023

(65) Prior Publication Data

US 2024/0122441 A1 Apr. 18, 2024

Related U.S. Application Data

(63) Continuation of application No. 16/997,089, filed on Aug. 19, 2020, now abandoned.

(60) Provisional application No. 62/888,752, filed on Aug. 19, 2019, provisional application No. 62/988,543, filed on Mar. 12, 2020.

(51) Int. Cl.

| | |
|---|---|
| ***A47L 17/00*** | (2006.01) |
| ***E03C 1/04*** | (2006.01) |
| ***E03C 1/22*** | (2006.01) |

(52) U.S. Cl.
CPC ..... *A47L 17/00* (2013.01); *E03C 1/0404* (2013.01); *E03C 1/22* (2013.01)

(58) Field of Classification Search
CPC ..... A47L 17/00; E03C 1/0404
USPC ..... 4/653; D23/238
See application file for complete search history.

(56) References Cited

U.S. PATENT DOCUMENTS

| | | | |
|---|---|---|---|
| 708,844 | A | 9/1902 | Sweeney |
| 737,247 | A | 8/1903 | Kammerer |
| 784,755 | A | 3/1905 | Pein |

(Continued)

FOREIGN PATENT DOCUMENTS

| | | |
|---|---|---|
| BE | 896360 | 8/1983 |
| BE | 1025325 B1 | 1/2019 |

(Continued)

OTHER PUBLICATIONS

United States Patent and Trademark Office, Before the Patent Trial and Appeal Board, Petition for Inter Partes Review, U.S. Pat. No. 11,473,277, *Wenzhou Xin Xin Sanitary Ware Co., Ltd.* V. *Delta Faucet Company*, filed Aug. 16, 2023, IPR2023-01332, 82 pages.

(Continued)

*Primary Examiner* — Christine J Skubinna
(74) *Attorney, Agent, or Firm* — Bose McKinney & Evans LLP

(57) ABSTRACT

A vessel rinsing apparatus including a mounting base, a fluid discharge member including a plurality of nozzles, a valve member operably coupled to the fluid discharge member and configured to control water flow through the nozzles, and an escutcheon supported by the mounting base.

20 Claims, 29 Drawing Sheets

(56) References Cited

U.S. PATENT DOCUMENTS

| | | | | |
|---|---|---|---|---|
| 3,092,120 | A | 6/1963 | Hilger et al. | |
| 6,152,381 | A * | 11/2000 | Hones | B05B 17/085 239/18 |
| 6,612,507 | B1 | 9/2003 | Meyer et al. | |
| 8,646,476 | B2 | 2/2014 | Thomas et al. | |
| 8,684,047 | B2 | 4/2014 | Hotaling | |
| 10,914,056 | B2 | 2/2021 | Cipriani et al. | |
| 11,473,277 | B2 | 10/2022 | Cipriani et al. | |
| 11,725,369 | B2 | 8/2023 | Cipriani et al. | |
| 2004/0060109 | A1 | 4/2004 | Hensley | |
| 2004/0168711 | A1 | 9/2004 | Dickson, Jr. et al. | |
| 2008/0142095 | A1* | 6/2008 | Van Der Linden | B67D 1/06 137/560 |
| 2011/0061754 | A1* | 3/2011 | Thomas | E03C 1/048 137/625.29 |
| 2012/0204342 | A1 | 8/2012 | Hotaling | |
| 2014/0215709 | A1 | 8/2014 | Nightlinger et al. | |
| 2014/0283877 | A1 | 9/2014 | Sonoda | |
| 2016/0324395 | A1 | 11/2016 | Cox et al. | |
| 2017/0162427 | A1 | 6/2017 | Gleissner et al. | |
| 2017/0172369 | A1 | 6/2017 | Gonzalez et al. | |
| 2018/0092505 | A1 | 4/2018 | Simon | |
| 2020/0087899 | A1 | 3/2020 | Cipriani et al. | |
| 2021/0052131 | A1 | 2/2021 | Cipriani et al. | |
| 2021/0156125 | A1 | 5/2021 | Cipriani et al. | |
| 2022/0389693 | A1 | 12/2022 | Cipriani et al. | |

FOREIGN PATENT DOCUMENTS

| | | | |
|---|---|---|---|
| CN | 86102485 | | 11/1986 |
| CN | 2260567 | Y | 8/1997 |
| CN | 101035735 | | 9/2007 |
| CN | 203281567 | U | 11/2013 |
| CN | 203750946 | U | 8/2014 |
| CN | 106572780 | | 4/2017 |
| CN | 206779097 | U | 12/2017 |
| CN | 108015069 | A | 5/2018 |
| DE | 3628724 | | 2/1988 |
| DE | 202007015486 | | 3/2009 |
| FR | 624156 | | 7/1927 |
| FR | 2543426 | | 5/1984 |
| FR | 2606622 | | 5/1988 |
| FR | 2704782 | | 11/1994 |
| GB | 262372 | | 12/1926 |
| GB | 264756 | | 1/1927 |
| KR | 101765550 | | 8/2017 |
| NL | 1033004 | | 6/2008 |
| WO | WO 2012/108735 | | 8/2012 |
| WO | 2015107560 | A1 | 7/2015 |

OTHER PUBLICATIONS

United States Patent and Trademark Office, Before the Patent Trial and Appeal Board, Notice of Filing Date Accorded to Petition and Time for Filing Patent Owner Preliminary Response, U.S. Pat. No. 11,473,277, *Wenzhou Xin Xin Sanitary Ware Co., Ltd.* V. *Delta Faucet Company*, filed Aug. 16, 2023, IPR2023-01332, 6 pages.

United States Patent and Trademark Office, Before the Patent Trial and Appeal Board, Patent Owner's Mandatory Notices, U.S. Pat. No. 11,473,277, *Wenzhou Xin Xin Sanitary Ware Co.* v. *Delta Faucet Company, Ltd.*, filed Sep. 6, 2023, IPR2023-01332, 5 pages.

United States Patent and Trademark Office, Before the Patent Trial and Appeal Board, Exhibit List, U.S. Pat. No. 11,473,277, *Wenzhou Xin Xin Sanitary Ware Co.* v. *Delta Faucet Company, Ltd.*, filed Aug. 16, 2023, IPR2023-01332, 2 pages.

United States Patent and Trademark Office, Before the Patent Trial and Appeal Board, Declaration of J. Chris Cook, U.S. Pat. No. 11,473,277, *Wenzhou Xin Xin Sanitary Ware Co.* v. *Delta Faucet Company, Ltd.*, filed Aug. 16, 2023, IPR2023-01332, 102 pages.

United States Patent and Trademark Office, Before the Patent Trial and Appeal Board, file wrapper of U.S. Pat. No. 10,914,056, filed Aug. 16, 2023, IPR2023-01332, 174 pages.

United States Patent and Trademark Office, Before the Patent Trial and Appeal Board, U.S. Pat. No. 11,473,277, filed Aug. 16, 2023, IPR2023-01332, 372 pages.

In the United States District Court for the District of New Jersey, Original Complaint, *Wenzhou Xin Xin Sanitary Ware Co., Ltd.* V. *Delta Faucet Company*, filed Apr. 11, 2023, IPR2023-01332, 9 pages.

In the United States District Court for the District of New Jersey, Answer, Affirmative, Defense, and Counterclaims, Jury Trial Demand, *Wenzhou Xin Xin Sanitary Ware Co., Ltd.* v. *Delta Faucet Company*, filed Jul. 28, 2023, IPR2023-01332, 48 pages.

Aluids, The Original Rinser, C4400, retrieved from www.aluids.com/product/the-original-rinser-glass-rinser-for-kitchen-sinks/ on Oct. 17, 2023, 2 pages.

Aluids, The Original Rinser, C4400-v2, retrieved from www.aluids.com/product/the-original-rinser-glass-rinser-for-kitchen-sinks/ on Oct. 17, 2023, 2 pages.

Aluids, The Original Rinser—for every corner of your drinkware, retrieved from www.aluids.com/the-original-rinser/ on Nov. 16, 2023, 20 pages.

United States Patent and Trademark Office, Before the Patent Trial and Appeal Board, Decision Denying Institution of Inter Partes Review, U.S. Pat. No. 11,473,277, *Wenzhou Xin Xin Sanitary Ware Co., Ltd.* v. *Delta Faucet Company*, Feb. 7, 2024, IPR2023-01332, 41 pages.

In the United States District Court for the Southern District of Indiana, Defendant's Answer, *Delta Faucet Company* v. *Wenzhou Xin Xin Sanitary Ware Co. Ltd.*, filed Apr. 11, 2024, Civil Action No. 1:23-cv-01633-MPB-TAB, 15 pages.

* cited by examiner

VESSEL RINSING APPARATUS, DRAIN RECEPTACLE, INTERCHANGEABLE NOZZLE ASSEMBLY, AND FAUCET SYSTEM INCLUDING SAME

CROSS-REFERENCE TO RELATED APPLICATIONS

The present application is a continuation of U.S. patent application Ser. No. 16/997,089, filed Aug. 19, 2020, which claims priority to U.S. Provisional Patent Application Ser. No. 62/888,752, filed Aug. 19, 2019, and U.S. Provisional Patent Application Ser. No. 62/988,543, filed Mar. 12, 2020, the disclosures of which are expressly incorporated herein by reference.

BACKGROUND AND SUMMARY OF THE DISCLOSURE

The present invention relates generally to a fluid dispensing system and, more particularly, to a vessel rinsing apparatus, a drain receptacle, and an interchangeable nozzle assembly for use with fluid vessels or receptacles, such as cups or glasses.

The interior of glasses, cups, and other small vessels or containers are often difficult to clean by removing dirt and debris after use. Conventional bottle brushes, sponges, rags and other disposable materials are often used to clean such small vessels but may not be effective, for example, as being incapable of fitting inside the vessel, and do not provide water for rinsing. In addition, typical faucets lack directional pressurized water flow required to adequately remove dirt and debris from extremities within the interiors of small vessels.

There remains a need for a vessel rinsing apparatus capable of being installed in a standard countertop opening, or integrated as part of a faucet escutcheon, which allows for the cleaning of small vessels, such as glasses and cups. There also remains a need for improved drain receptacles for vessel rinsing apparatus. There also remains a need for improved nozzle assemblies for vessel rinsing apparatus.

According to an illustrative embodiment of the present disclosure, a drain receptacle for a vessel rinsing apparatus includes a receiving portion configured to receive water. An upwardly extending wall includes a first end and a second end. A lower wall is coupled to the upwardly extending wall, and the lower wall and the upwardly extending wall together define a drain channel in fluid communication with the receiving portion. The lower wall includes a water delivery edge in fluid communication with the drain channel and configured to deliver water thereover. The water delivery edge is disposed upstream relative to the first end and the second end of the upwardly extending wall.

According to another illustrative embodiment of the present disclosure, a drain receptacle for a vessel rinsing apparatus includes a receiving portion configured to receive water. A lower wall includes a water delivery edge in fluid communication with the receiving portion and configured to deliver water thereover. An upwardly extending wall is coupled to the lower wall. The upwardly extending wall includes a first end disposed on a first side and downstream of the water delivery edge and a second end disposed on a second side and downstream of the water delivery edge.

According to yet another illustrative embodiment of the present disclosure, an open waterway includes a lower wall defining a waterway configured to receive water. The lower wall includes a water delivery edge in fluid communication with the waterway and configured to deliver water thereover. A first sidewall is coupled to the lower wall on a first side of the waterway, and the first sidewall includes a first end disposed downstream of the water delivery edge. A second sidewall is coupled to the lower wall on a second side of the waterway, and the second sidewall comprises a second end disposed downstream of the water delivery edge.

According to yet another illustrative embodiment of the present disclosure, a vessel rinsing apparatus includes a mounting base including an upper coupler and a downwardly extending mounting shank defining an opening extending along a longitudinal axis. The upper coupler is configured to be supported above an upper surface of a mounting deck, and the mounting shank configured to extend through a mounting aperture formed within the mounting deck. A fluid discharge member includes a central body and a trigger extending outwardly from the central body, and the central body is received within the opening of the mounting shank and is movable along the longitudinal axis. A first nozzle assembly is configured to detachably couple to the central body, and the first nozzle assembly includes a first plurality of nozzles. A second nozzle assembly is configured to detachably couple to the central body, and the second nozzle assembly includes a second plurality of nozzles. A valve shaft operably couples to the fluid discharge member and is configured to move with the trigger to control water flow through the central body to the first plurality of nozzles or the second plurality of nozzles. An escutcheon is supported by the upper coupler of the mounting base. The escutcheon includes an upwardly extending wall that defines a drain bowl and a drain channel extending through the upwardly extending wall. The drain channel is configured to provide fluid communication between the drain bowl and a sink basin supported by the mounting deck.

According to an illustrative embodiment of the present disclosure, a faucet assembly is configured to be coupled to a mounting deck, and the mounting deck supports a sink basin. The faucet assembly includes a faucet, and the faucet includes an escutcheon configured to be supported above the mounting deck and a faucet spout coupled to the escutcheon and configured to discharge water therefrom. The faucet assembly further includes a vessel rinsing apparatus, and the vessel rinsing apparatus includes a drain receptacle monolithically coupled to the escutcheon. The drain receptacle includes a receiving portion configured to receive water, a lower wall including a water delivery edge in fluid communication with the receiving portion and configured to deliver water thereover and thereby provide fluid communication between the drain receptacle and the sink basin, and an upwardly extending wall coupled to the lower wall. The vessel rinsing apparatus further includes a fluid discharge member including a central body supporting a plurality of nozzles and a trigger extending outwardly from the central body, the trigger being movable relative to the drain receptacle. The vessel rinsing apparatus further includes a valve operably coupled to the fluid discharge member and configured to move with the trigger to control water flow through the central body to the plurality of nozzles.

According to yet another illustrative embodiment of the present disclosure, a faucet assembly is configured to be coupled to a mounting deck, the mounting deck including a first mounting aperture and a second mounting aperture, and the mounting deck supporting a sink basin. The faucet assembly includes a faucet, and the faucet includes an escutcheon configured to be supported above the mounting deck and a faucet spout coupled to the escutcheon and configured to discharge water therefrom. The faucet spout has a central axis. A vessel rinsing apparatus is coupled to the faucet, and the vessel rinsing apparatus includes a drain receptacle including a receiving portion configured to receive water, a lower wall including a water delivery edge in fluid communication with the receiving portion and configured to deliver water thereover and thereby provide fluid communication between the drain receptacle and the sink basin, and an upwardly extending wall coupled to the lower wall. The vessel rinsing apparatus further includes a fluid discharge member including a central body supporting a plurality of nozzles and a trigger extending outwardly from the central body, the trigger being movable relative to the drain receptacle. The vessel rinsing apparatus further includes a valve operably coupled to the fluid discharge member and configured to move with the trigger to control water flow through the central body to the plurality of nozzles. A first mounting shank is coupled to the vessel rinsing apparatus and configured to extend through the first mounting aperture of the mounting deck, and the first mounting shank is disposed apart from the central axis of the faucet spout by a first distance. A second mounting shank is coupled to the escutcheon and configured to extend through the second mounting aperture of the mounting deck, and the second mounting shank is disposed apart from the central axis of the faucet spout by a second distance, the second distance being substantially equal to the first distance.

According to yet another illustrative embodiment of the present disclosure, a vessel rinsing apparatus includes a drain receptacle, and the drain receptacle includes a receiving portion, a drain channel in fluid communication with the receiving portion, and a water delivery edge in fluid communication with the drain channel and configured to deliver water thereover. A fluid discharge member is coupled to the drain receptacle, and the fluid discharge member includes a central body movably coupled to the drain receptacle, a plurality of nozzles coupled to the central body and eccentrically disposed relative to the receiving portion, and a trigger coupled to and movable with the central body relative to the drain receptacle. A valve is operably coupled to the fluid discharge member and configured to move with the trigger to control water flow through the central body to the plurality of nozzles.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
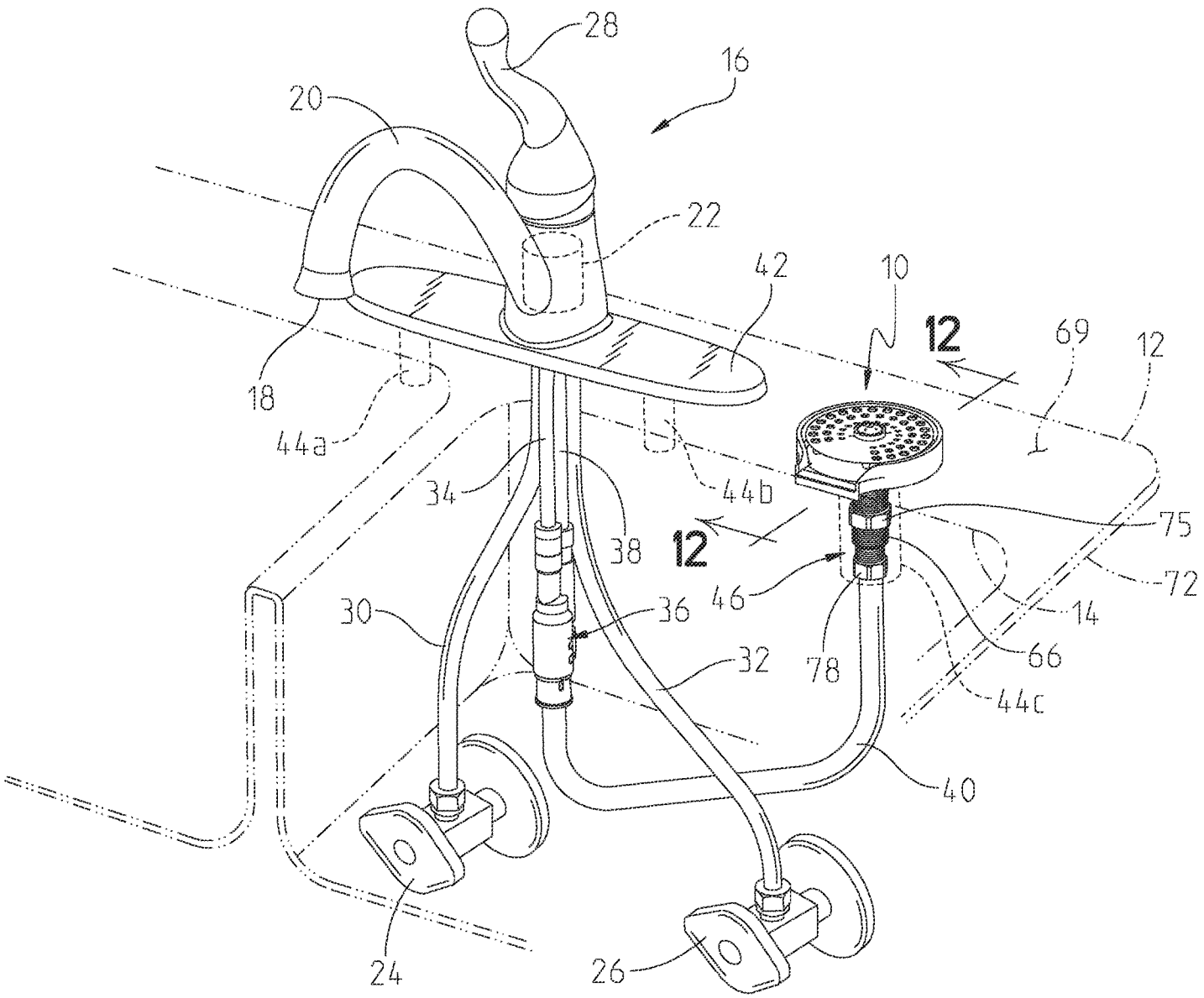
FIG. 1 is a perspective view of an illustrative vessel rinsing apparatus mounted to a sink deck and fluidly coupled to a faucet.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 2:
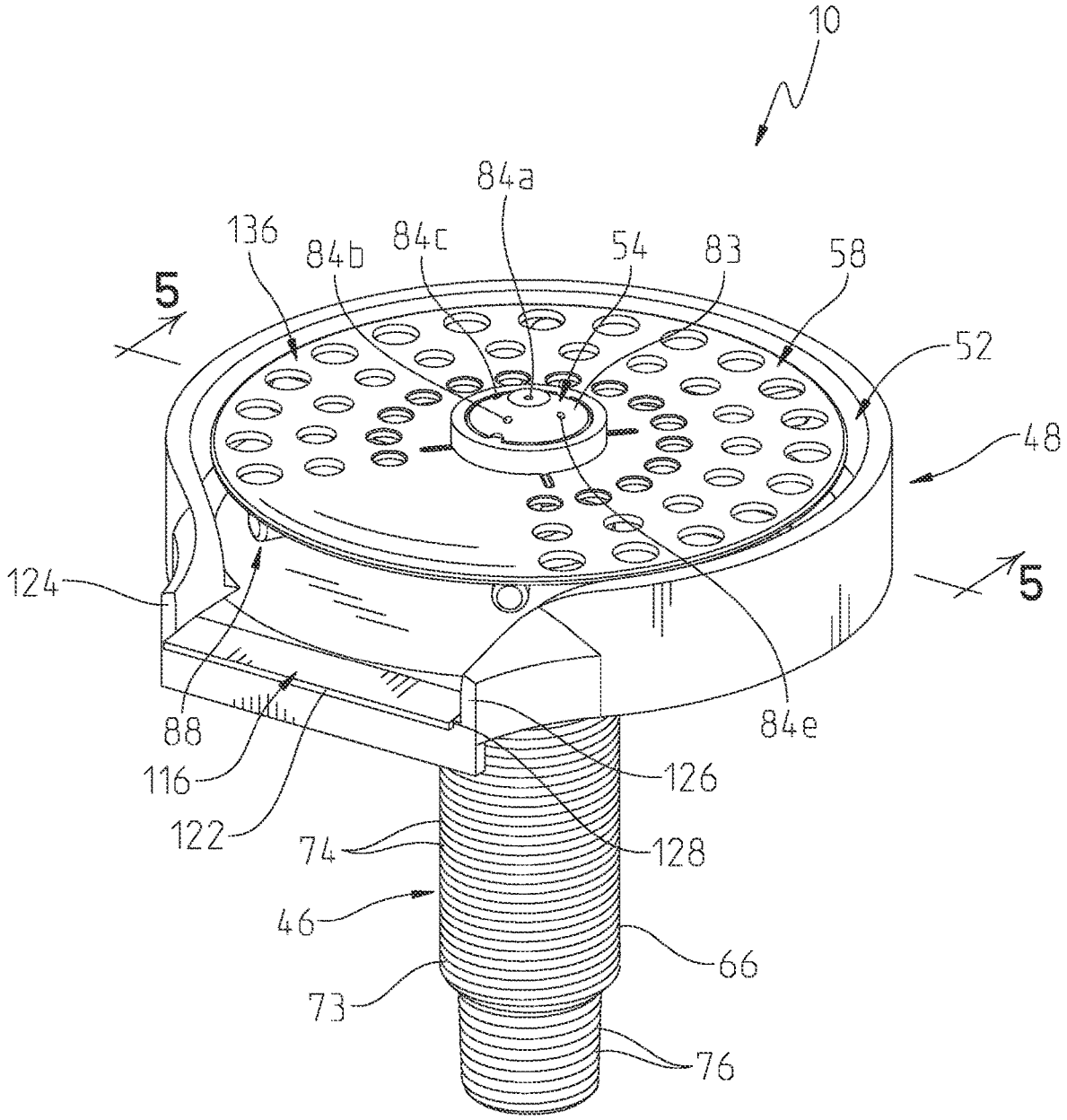
FIG. 2 is a perspective view of the vessel rinsing apparatus of FIG. 1.

With reference initially to FIGS. 1 and 2, an illustrative vessel rinsing apparatus 10 is shown supported by a conventional mounting deck, such as a sink deck 12 supporting a sink basin 14. A faucet 16 may be supported by the sink deck 12 for discharging water from a water outlet 18 into the sink basin 14. The faucet 16 may be of conventional design, including a delivery spout 20 defining the water outlet 18, and a manual mixing valve 22 for controlling water flow from a hot water supply 24 and a cold water supply 26 to the water outlet 18. The mixing valve 22 includes a valve handle 28 to control the flow rate and the temperature of water delivered to the water outlet 18. A hot water supply tube 30 may fluidly couple the hot water supply 24 to a first inlet of the mixing valve 22, and a cold water supply tube 32 may fluidly couple the cold water supply 26 to a second inlet of the mixing valve 22. A mixed water outlet tube 34 may fluidly couple an outlet of the mixing valve 22 a diverter valve 36.

The diverter valve 36 illustratively controls (e.g., toggles) water flow between the outlet 18 of the delivery spout 20 and the vessel rinsing apparatus 10. An illustrative diverter valve 36 is detailed in U.S. Pat. No. 8,646,476, the disclosure of which is expressly incorporated by herein by reference. A spout outlet tube 38 fluidly couples the diverter valve 36 to the outlet 18, while a dispenser tube 40 fluidly couples the diverter valve 36 to the vessel rinsing apparatus 10. As such, the mixing valve 22 may be manipulated by the handle 28 to control the temperature and flow rate of water delivered to the active outlet(s) selected by the diverter valve 36 (e.g., the delivery spout outlet 18 and the glass rinsing apparatus 10). The various water tubes 30, 32, 34, 38 and 40 may be formed of a flexible polymer, such as a cross-linked polyethylene (PEX).

An escutcheon 42 may be positioned intermediate the sink deck 12 and the delivery spout 20. A plurality of mounting apertures 44 may extend within the sink deck 12, wherein at least some of the apertures 44*a*, 44*b* may be used to couple the faucet 16 to the sink deck 12. In the illustrative embodiment, the glass rinsing apparatus 10 is fixed to the mounting aperture 44*c* that would conventionally support a kitchen side sprayer (not shown) adjacent the sink basin 14. Such positioning facilitates draining of the vessel rinsing apparatus 10 into the sink basin 14.

Figure 3:
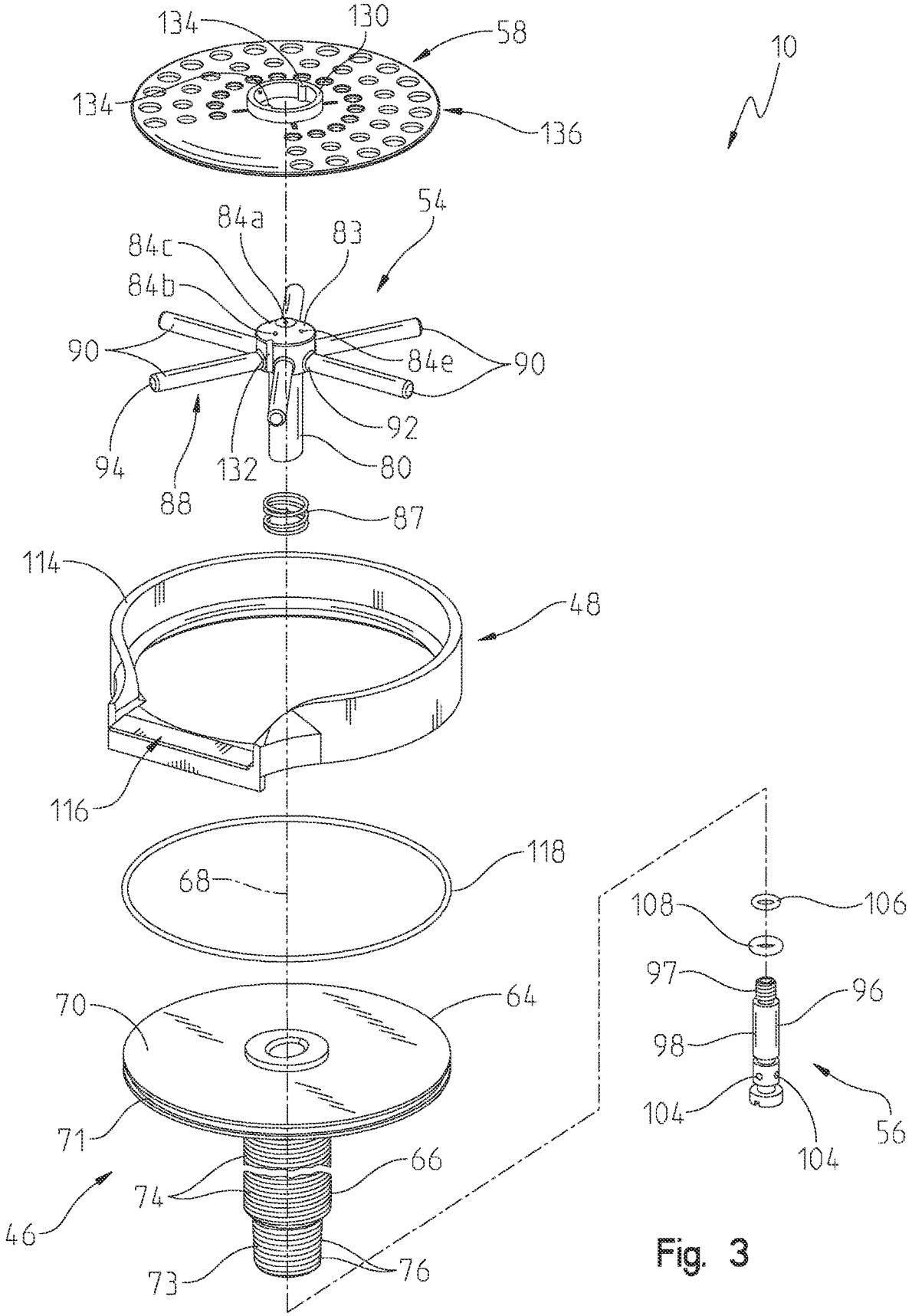
FIG. 3 is a top exploded perspective view of the vessel rinsing apparatus of FIG. 2.
Figure 4:
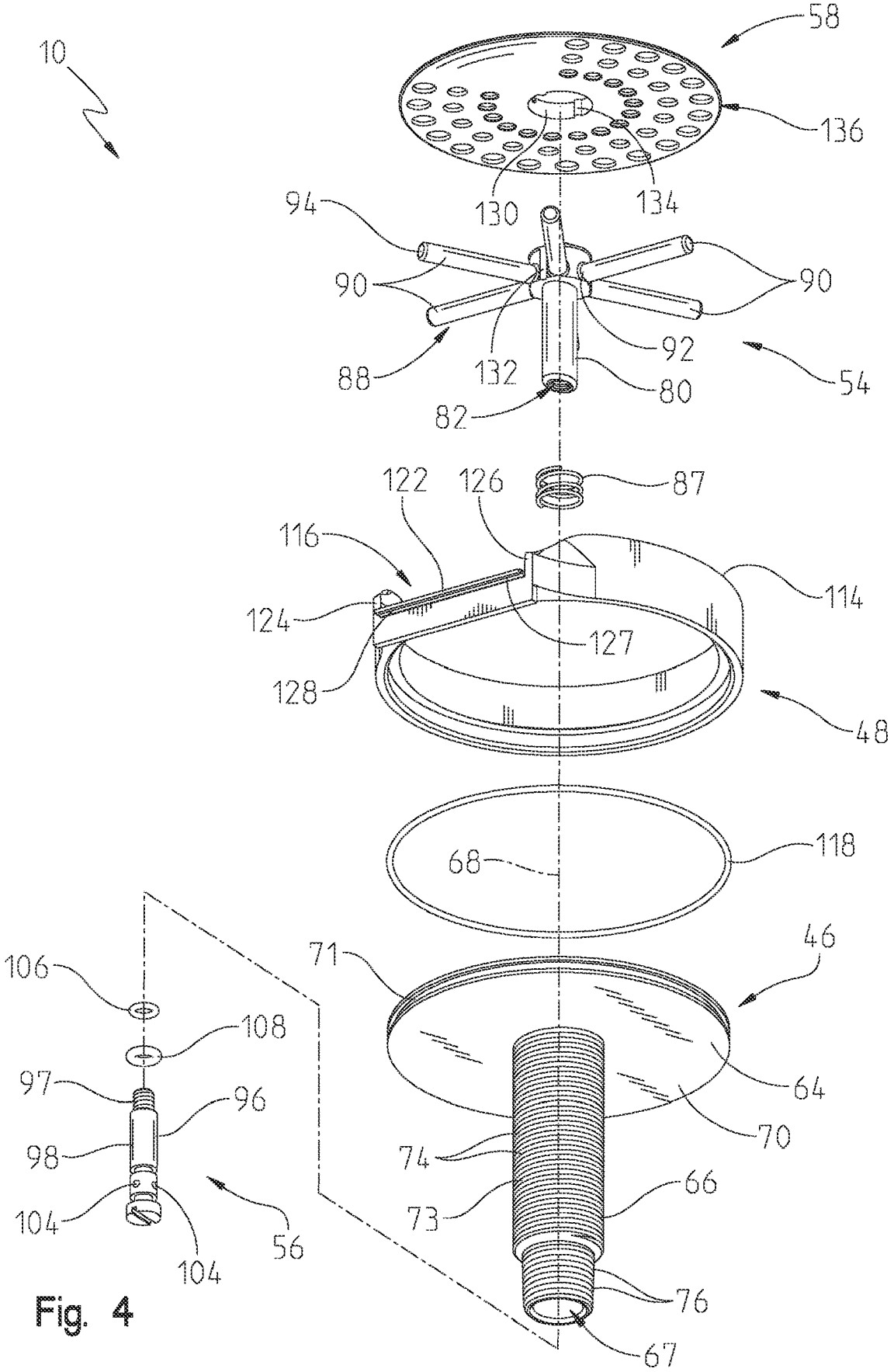
FIG. 4 is a bottom exploded perspective view of the vessel rinsing apparatus of FIG. 2.
Figure 5:
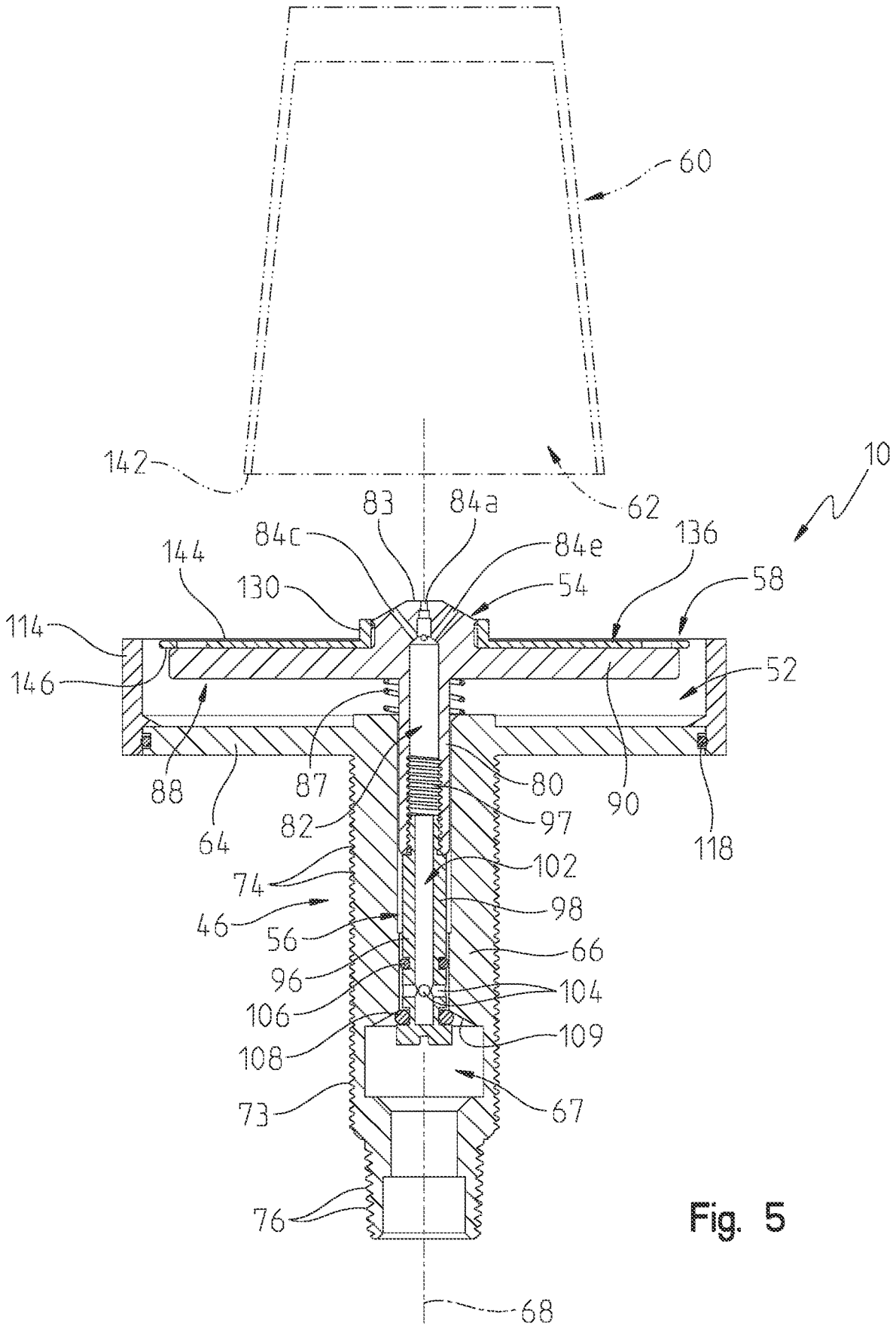
FIG. 5 is a cross-sectional view of the vessel rinsing apparatus taken along line 5-5 of FIG. 2, showing the discharge member in a closed position and a vessel shown in phantom.

With reference to FIGS. 2-4, the illustrative vessel rinsing apparatus 10 includes a mounting base 46 configured to be coupled to the sink deck 12. An escutcheon 48 illustratively cooperates with the mounting base 46 to define a contoured drain receptacle or bowl 52 for the collection and disposal of debris and wastewater. A fluid discharge member 54 is operably coupled to the mounting base 46 and to a valve member 56. A trigger plate 58 is supported by the fluid discharge member 54 and is configured to be engaged by a vessel 60 (e.g., a cup, glass or other container) for activating water flow through the fluid discharge member 54 and into an interior 62 of the vessel 60 (FIGS. 5 and 6).

The mounting base 46 illustratively includes an upper coupler, such as an upper plate 64, and a downwardly extending mounting shank 66 defining an opening 67 extending along a longitudinal axis 68. The upper plate 64 is configured to be supported above an upper surface 69 of the sink deck 12 and illustratively comprises a disk 70 having a circular peripheral edge 71. The mounting shank 66 is configured to extend through one of the mounting apertures 44*c* formed within the sink deck 12 and below a lower surface 72 of the sink deck 12. The mounting shank 66 illustratively includes a stepped cylindrical tube 73 having upper external threads 74 configured to threadably couple with a mounting nut 75 for securing the mounting base 46 to the sink deck 12 (FIG. 1). Illustratively, the dispenser tube 40 is fluidly coupled to the mounting shank 66 to provide water from a water supply (illustratively via the mixing valve 22 through the diverter valve 36). More particularly, the cylindrical tube 73 of the mounting shank 66 illustratively includes lower external threads 76 configured to engage with a fitting 78 to fluidly couple the dispenser tube 40 to the mounting shank 66 (FIG. 1).

With reference to FIGS. 3-6, the fluid discharge member 54 cooperates with the mounting base 50 to deliver water from the dispenser tube 40. The fluid discharge member 54 illustratively includes a central body 80 defining a fluid passageway 82 and having a sprayface 83 supporting a plurality of nozzles 84 in fluid communication with the fluid passageway 82. More particularly, the nozzles 84 may include a center nozzle 84*a* and a plurality of peripheral nozzles 84*b*, 84*c*, 84*d*, 84*e* positioned radially outward from the center nozzle 84*a*. It should be appreciated that the number and placement of the nozzles 84 may vary.

Figure 6:
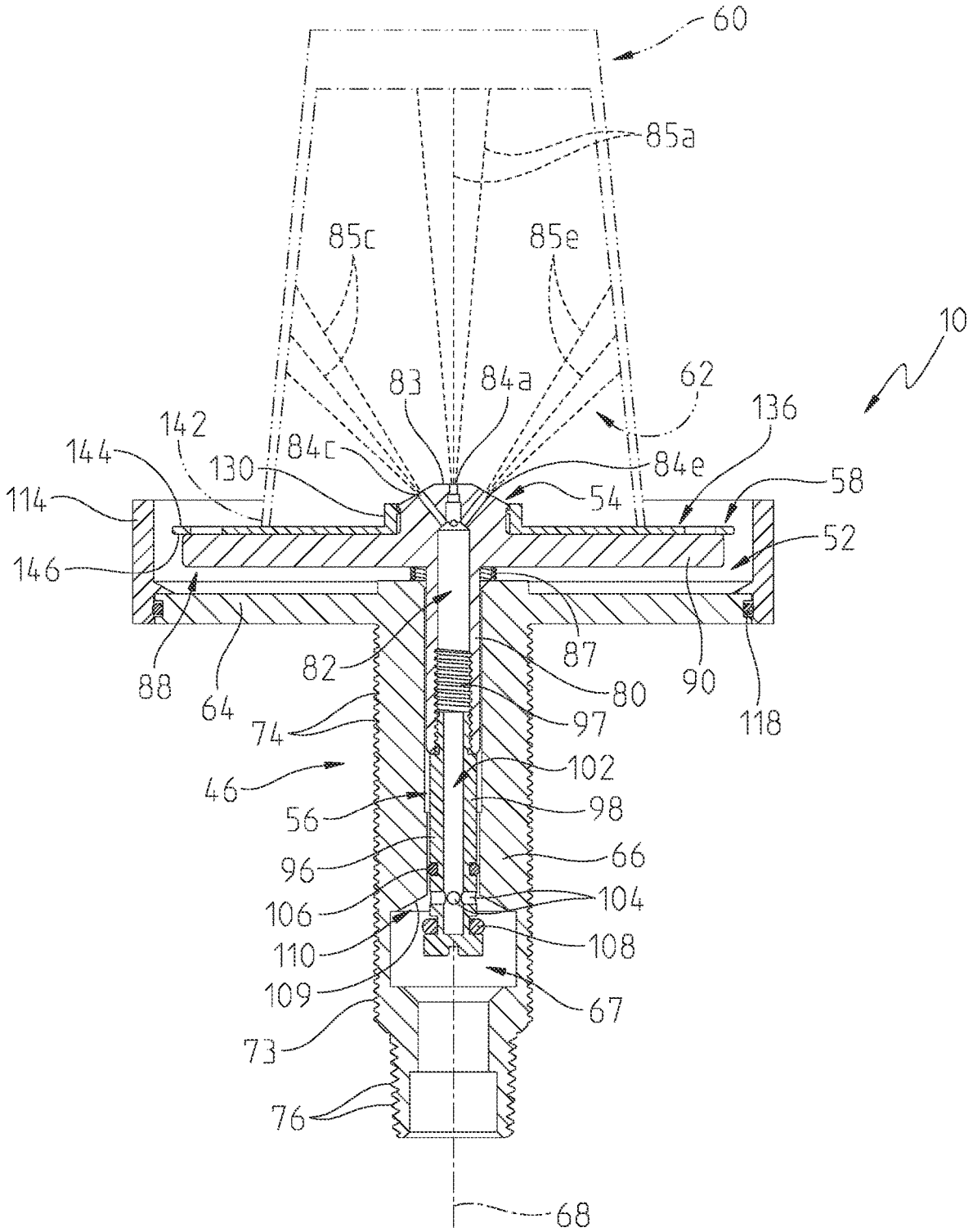
FIG. 6 is a cross-sectional view of the vessel rinsing apparatus similar to FIG. 5, showing the discharge member in an open position and a vessel shown in phantom.

In one illustrative embodiment, the nozzles 84 may be oriented to direct water in different desired positions within an interior 86 of the vessel 60, as represented by arrows 85 in FIG. 6. For example, the center nozzle 84*a* may be configured to discharge water upwardly parallel to the longitudinal axis 68. Illustratively, a first peripheral nozzle 84*b* may be oriented at a first angle from the longitudinal axis 68 for directing water to a distal corner of a mug, a second peripheral nozzle 84*c* may be oriented at a second angle from the longitudinal axis 68 for directing water to a distal corner of a highball glass, a third peripheral nozzle 84*d* may be oriented at a third angle from the longitudinal axis 68 for directing water to a distal corner of a tumbler or pint glass, and a forth peripheral nozzle 84*e* may be oriented at a fourth angle from the longitudinal axis 68 for directing water to a distal portion of a wine glass.

The central body 80 of the fluid discharge member 54 is slideably received within the opening 67 of the mounting shank 66 such that it is moveable along the longitudinal axis 68. More particularly, the fluid discharge member 54 is configured to move along the longitudinal axis 68 between a raised (or rest) position (FIG. 5), and a lowered (or active) position (FIG. 6). A spring 87 may cooperate with the mounting base 46 to bias the discharge member 54 to the upper position. The fluid discharge member 54 may be restrained from rotating relative to the mounting base 50. Illustratively, the central body 80 has an elongated cross section (e.g. oval) thereby preventing rotation within the opening 67. Other rotatable couplers, such as a key received within a keyway, may be substituted therefor.

A trigger 88 extends outwardly from the central body 80. The trigger 88 illustratively includes a plurality of radially outwardly extending arms or posts 90, each having a first end 92 supported by the central body 80 and a freely supported second end 94.

The valve member 56 illustratively comprises a valve pin or shaft 96 operably coupled to the fluid discharge member 54 (e.g., via a threaded coupling 97), and is configured to move with the trigger 88 to control water flow through the central body 80 to the plurality of nozzles 84. More particularly, the valve shaft 96 illustratively includes a hollow body 98 defining a fluid passageway 102 in fluid communication with the fluid passageway 82 of the central body 80 via radial openings 104. Upper and lower o-rings 106 and 108 are positioned above and below openings 104, respectively. The valve member 56 may be a separate component from the fluid discharge member 54, or formed integral therewith.

In the raised position as shown in FIG. 5, the valve shaft 96 blocks water flow from the fluid source (e.g., the mixing valve 22) to the nozzles 84. More particularly, the o-ring 108 seals against a valve seat 109 to prevent water flow from opening 67 to the fluid passageway 102. In the lowered position as shown in FIG. 6, the valve shaft 96 provides fluid communication between the fluid source and the nozzles 84. More particularly, a passageway 110 between the o-ring 108 and the valve seat 109 permits water flow therethrough from opening 67 to fluid passageway 102 through openings 104, and through the fluid passageway 82 to the nozzles 84

Figure 12:
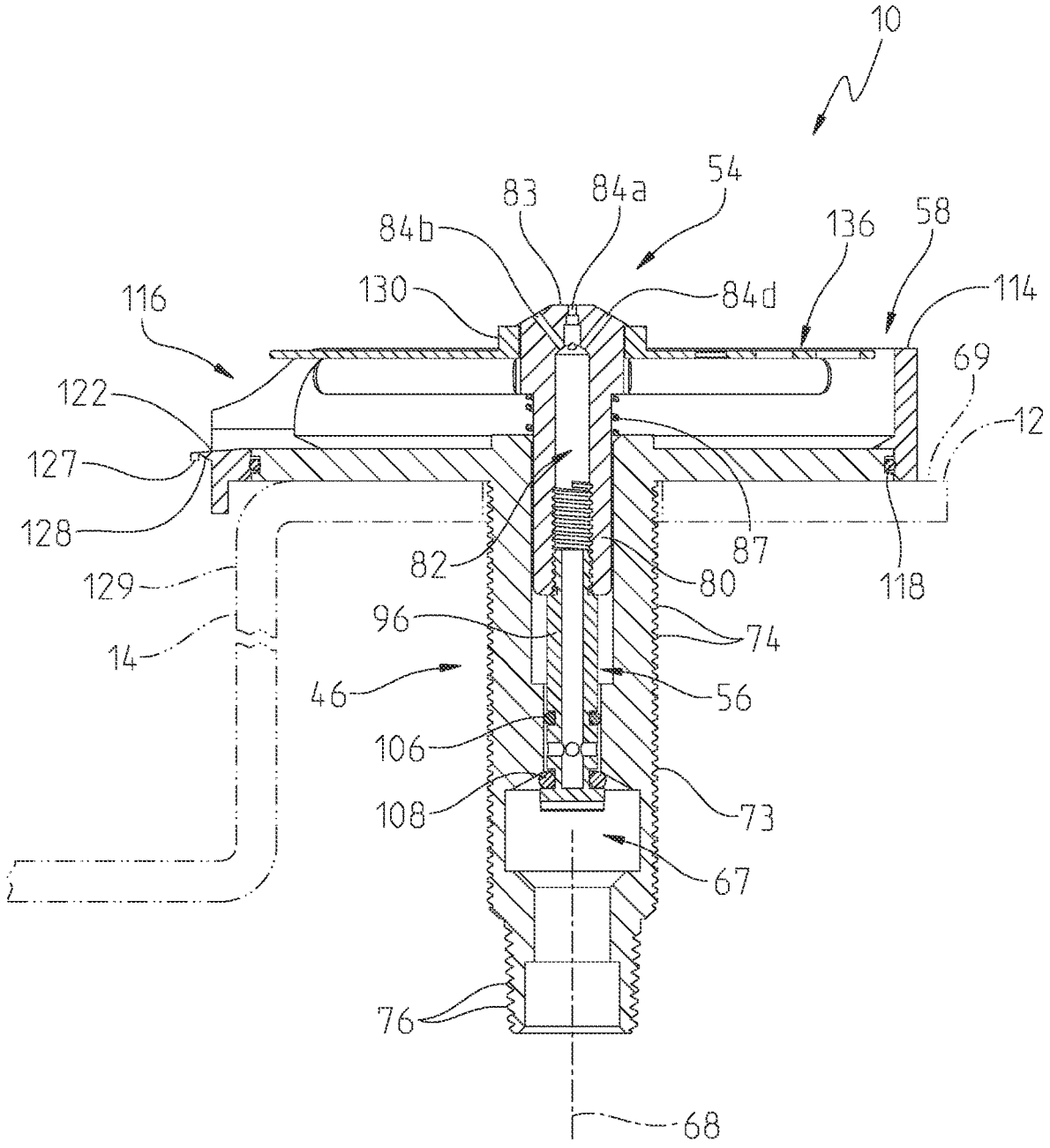
FIG. 12 is a cross-sectional view of the vessel rinsing apparatus taken along line 12-12 of FIG. 1, showing the drain channel in fluid communication with a sink basin.

The escutcheon 48 is supported by the mounting base 50 and illustratively includes an upwardly extending wall 114 and a drain channel 116 extending through the upwardly extending wall 114. As shown in FIGS. 1 and 12, the drain channel 116 is configured to provide fluid communication between the drain bowl 52 and the sink basin 14 supported by the sink deck 12. The upper plate 64 of the mounting base 50 and the upwardly extending wall 114 of the escutcheon 42 illustratively define the drain bowl 52. An o-ring 118 is illustratively supported by the peripheral edge 71 of the upper plate 64 to releasably retain the escutcheon 48 to the mounting base 50. As such, the escutcheon 48 may be exchanged with other escutcheons with different aesthetic shapes, finishes and/or drain channel 116 dimensions.

The drain channel 116 illustratively includes a lower wall 122 and opposing side walls 124 and 126. A lip 127 and an associated undercut 128 formed in a lower surface of the lower wall 122 prevents wastewater flowing through the drain channel 116 from running back toward the rear wall 129 of the sink basin 14. More particularly, the undercut 128 cooperates with the lip 127 to direct water downward.

In an illustrative embodiment, the trigger plate 58 is removably supported by the trigger 88 of the fluid discharge member 54 above the drain bowl 52. More particularly, the removeable trigger plate 58 is illustratively supported by the arms 90 of the trigger 88. Illustratively, a retaining ring 130 concentrically receives and frictionally engages the body 80 to releasably secure the trigger plate 58 to the fluid discharge member 54. The removable trigger plates 58 can be cleaned, replaced and/or exchanged with other trigger plates 58 that may have different cleaning benefits (e.g., characteristics of a brush or sponge).

Anti-rotation members may be configured to prevent rotation of the removeable trigger plate 58 about the longitudinal axis 68 relative to the fluid discharge member 54. The anti-rotation members may comprise a recess 132 supported by the fluid discharge member, and cooperating tabs 134 supported by the removeable trigger plate 58.

Figure 7:
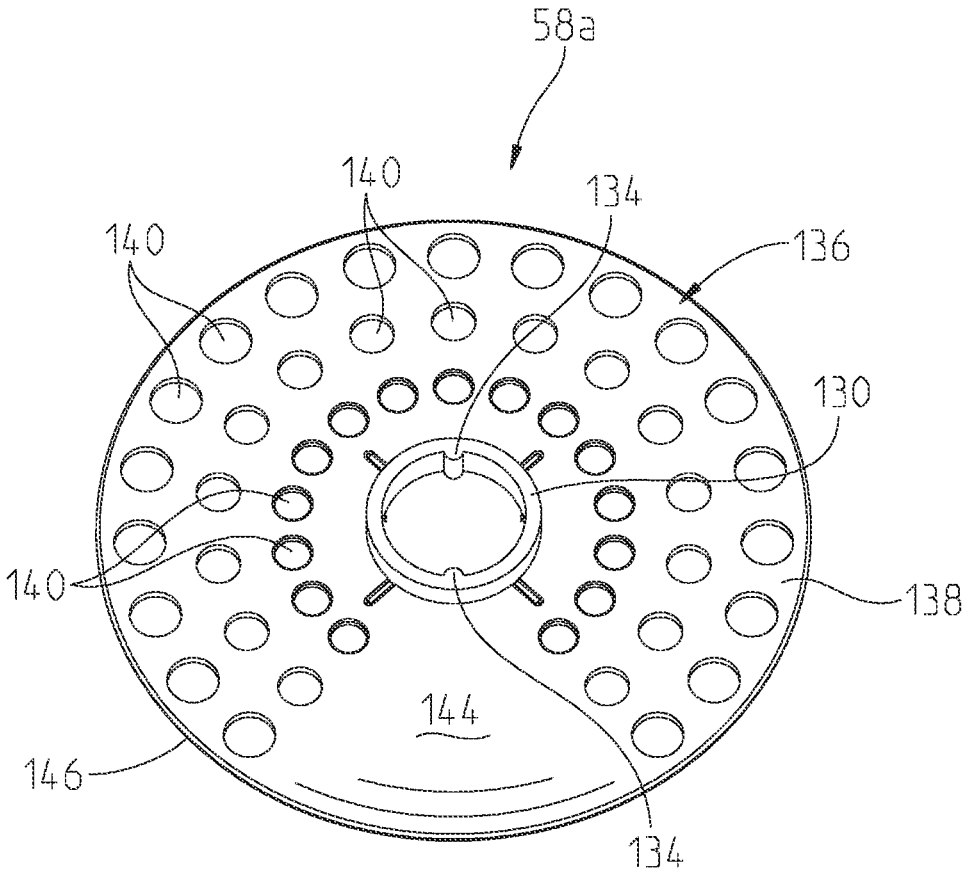
FIG. 7 is a perspective view of a first removable plate of the vessel rinsing apparatus of FIG. 2 in the form of a strainer.

With reference to FIG. 7, a first removeable trigger plate 58*a* may comprise a strainer 136 including a base 138 and a plurality of circumferentially spaced drain openings 140 arranged in a plurality of radially spaced rows. As a rim 142 of the glass 60 contacts the upper surface 144 of the strainer 136, a lower surface 146 of the strainer 136 engages the trigger 88 (FIGS. 5 and 6).

Figure 8:
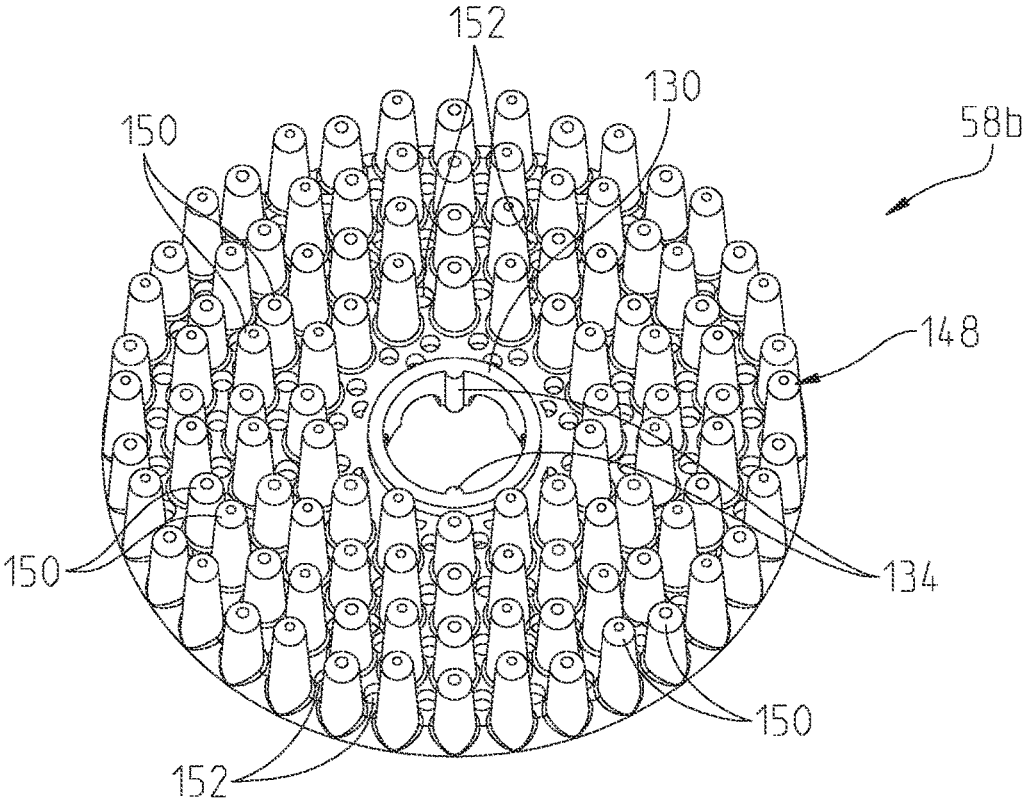
FIG. 8 is a perspective view of a second removable plate of the vessel rinsing apparatus of FIG. 2 in the form of a cleaning brush, with a plurality of first cleaning projections.

As shown in FIG. 8, a second removeable trigger plate 58*b* may comprise an elastomeric brush 148 including a plurality of upwardly extending projections or pegs 150 and a plurality of drain openings 152 positioned intermediate adjacent cleaning projections 150. The rim 142 of the glass 60 is configured to be received between adjacent cleaning projections 150 to assist in cleaning the inner and outer surfaces of the rim 142.

Figure 9:
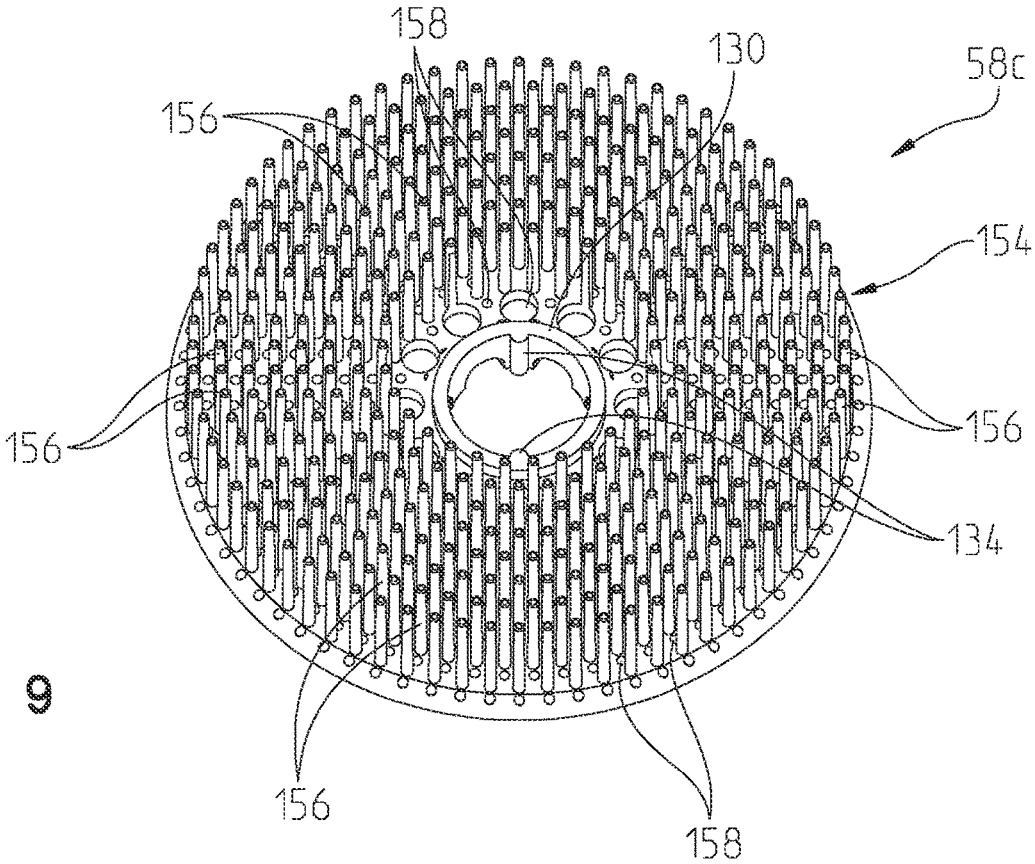
FIG. 9 is a perspective view of a third removable plate of the vessel rinsing apparatus of FIG. 2 in the form of a cleaning brush, with a plurality of second cleaning projections.
Figure 10:
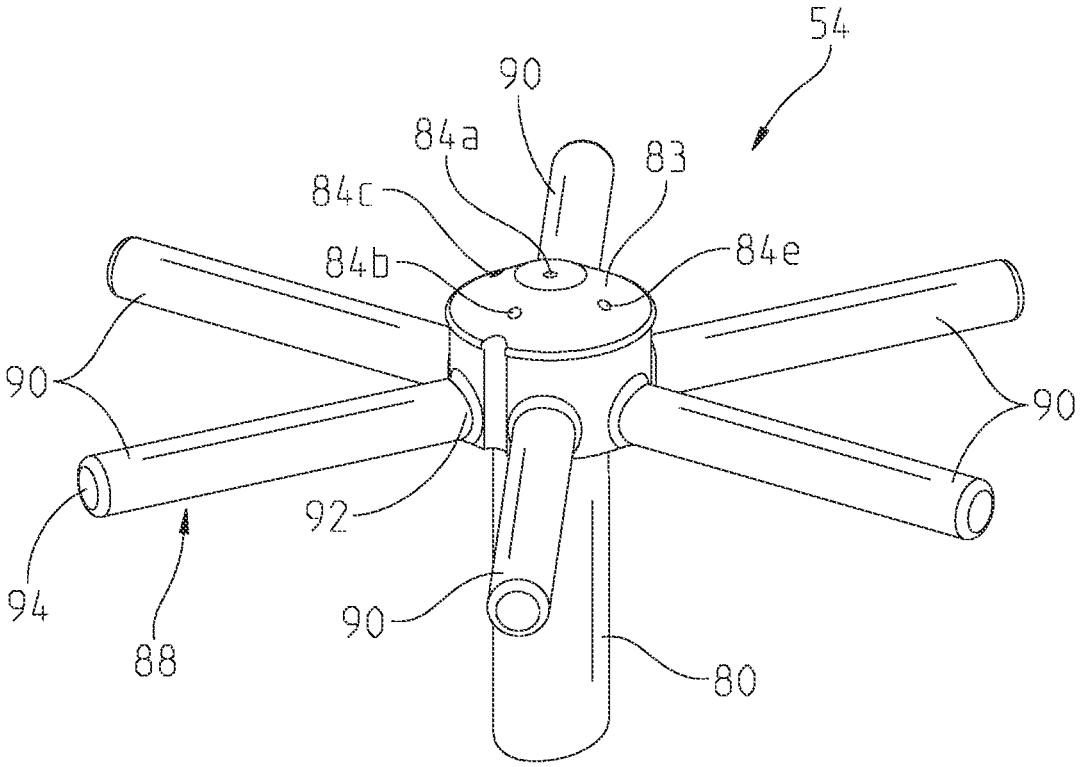
FIG. 10 is a perspective view of a fluid discharge member of the vessel rinsing apparatus of FIG. 2.
Figure 11:
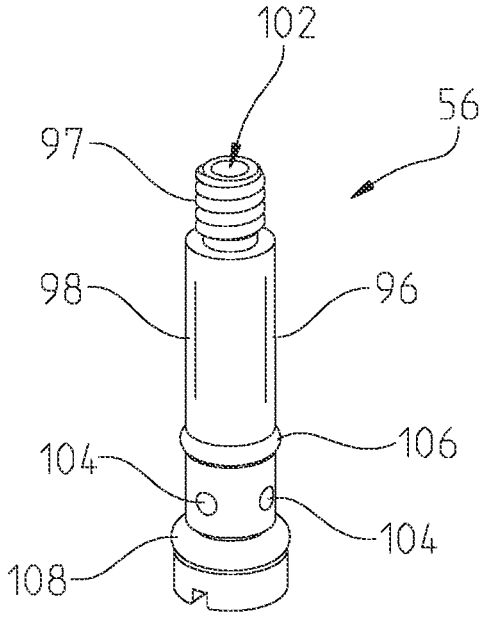
FIG. 11 is a perspective view of a valve shaft of the vessel rinsing apparatus of FIG. 2.

As shown in FIG. 9, a third removable trigger plate 58*c* may comprise an elastomeric brush 154 similar to that shown in FIG. 8. More particularly, the brush 154 includes a plurality of upwardly extending projections or bristles 156 and a plurality of drain openings 158 positioned intermediate adjacent cleaning projections 156.

Figure 13:
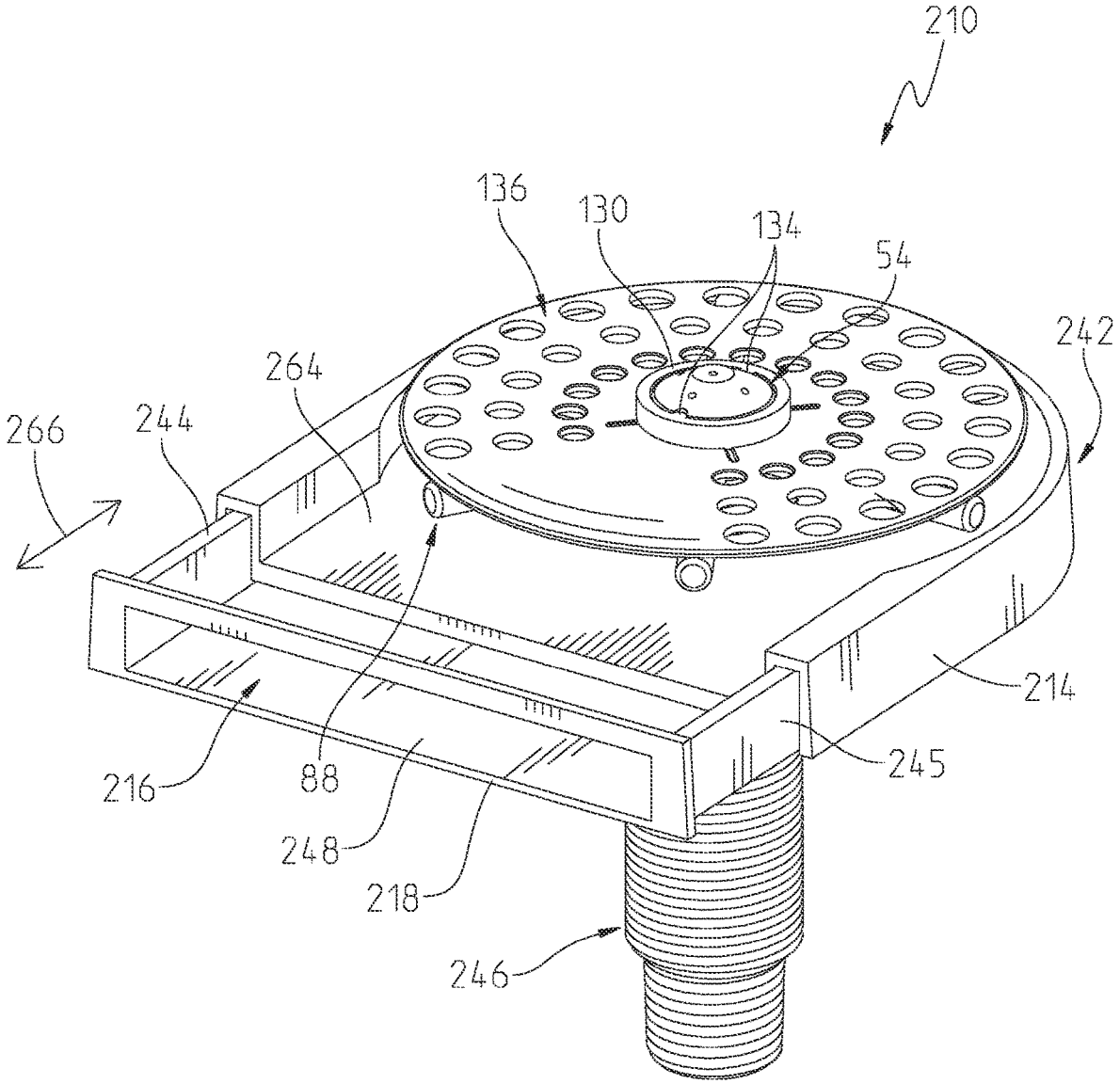
FIG. 13 is a perspective view of another illustrative embodiment of a vessel rinsing apparatus.

A further illustrative embodiment of a vessel rinsing apparatus 210 is shown in FIG. 13 as including many of the same elements as the vessel rinsing apparatus 10 detailed above. As such, in the following description, like components are identified with similar reference numbers. The drain channel 216 of the vessel rinsing apparatus 210 includes a movable tray 218 supported by the upper wall 214 of the escutcheon 242. Move particularly, the movable tray 218 includes opposing side walls 244, 245 supported by a lower wall 248. The side walls 244, 245 are slidably received within the upper wall 214 of the escutcheon 242, and the lower wall 248 is slidably received within the upper plate 264 of the mounting base 246. As such, the relative position of the drain channel 216 may be adjusted (as shown by arrows 266) to facilitate wastewater discharge into the sink basin 14. More particularly, the removable tray 218 accommodates different dimensions between the mounting aperture 44*c* and the sink basin 14.

Figure 14:
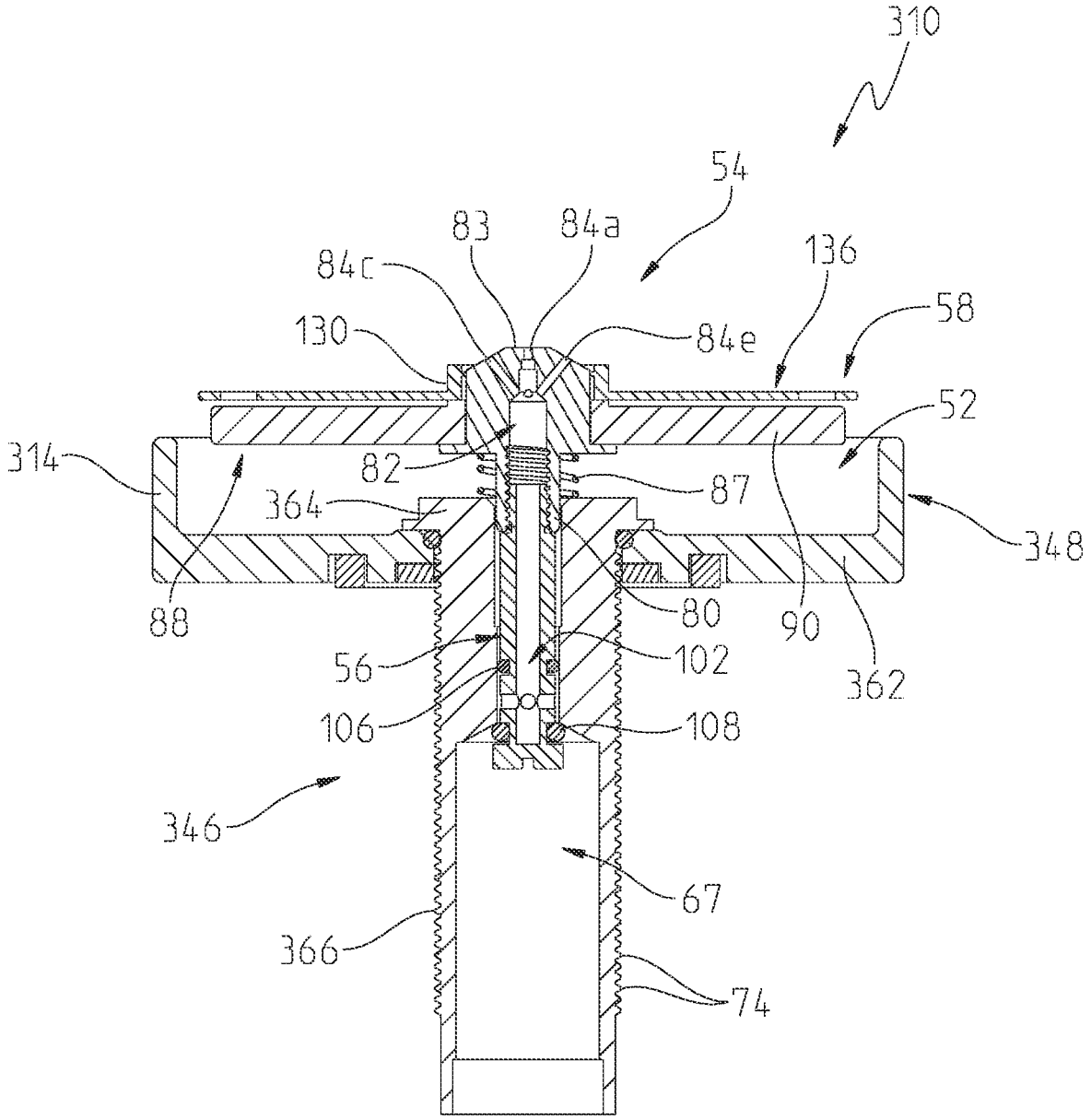
FIG. 14 is a cross-sectional view similar to FIG. 5 of a further illustrative embodiment of a vessel rinsing apparatus.

Another illustrative embodiment of a vessel rinsing apparatus 310 is shown in FIG. 14 as including many of the same elements as the vessel rinsing apparatus 10 detailed above. As such, in the following description, like components are identified with similar reference numbers. The vessel rinsing apparatus 310 includes a mounting base 346 including a mounting shank 366 and an upper coupler 364. The escutcheon 348 illustratively includes a lower wall 362 and an upwardly extending wall 314 defining the drain bowl 52.

Figure 15:
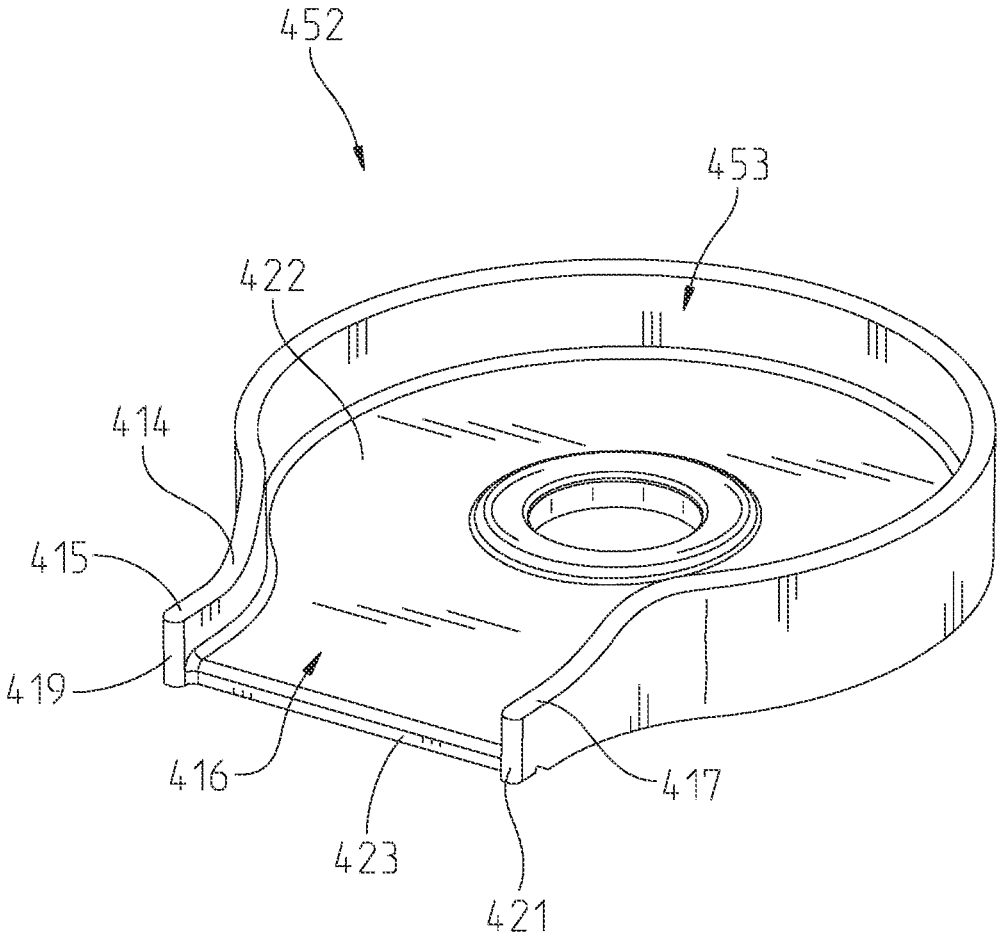
FIG. 15 is a perspective view of an illustrative drain receptacle.

An illustrative embodiment of a drain receptacle 452 or bowl is shown in FIG. 15. In some embodiments, the drain receptacle 452 may be used with any of the vessel rinsing apparatus described herein. For example, the vessel rinsing apparatus 10 may include the drain receptacle 452 in lieu of the drain receptacle 52. The drain receptacle 452 may be formed as a monolithic component (for example, in a similar manner as the escutcheon 348 detailed above) or by multiple components (for example, in a similar manner as the escutcheon 48 and the mounting base 46 form the drain receptacle 52 detailed above). The drain receptacle 452 may be formed by one or more hydrophilic materials, such as polished chrome.

Generally, the drain receptacle 452 includes features that facilitate delivering wastewater therefrom and inhibit wastewater from accumulating thereon after rinsing a vessel. More specifically, the drain receptacle 452 includes a lower wall 422 and an upwardly extending wall 414 that together define a receiving portion 453 or volume for receiving wastewater from a vessel rinsed by the vessel rinsing apparatus. The lower wall 422 and a first sidewall 415 and a second sidewall 417 of the upwardly extending wall 414 define a drain channel 416 in fluid communication with the receiving portion 453. The lower wall 422 also includes a water delivery edge 423 in fluid communication with the drain channel 416. The water delivery edge 423 is configured to deliver water thereover. Illustratively, the water delivery edge 423 has a round or curved shape that permits water to move thereover and fall from the drain receptacle 452. The water delivery edge 423 may have a radius in a range of about 3 mm to about 1.27 mm (as used herein, the term "about" meaning within 5 percent), or about 2 mm to about 1.27 mm. In other embodiments, the water delivery edge 423 may have other shapes, such as a non-curved shape, or lack a radius. The water delivery edge 423 is disposed upstream relative to a first end 419 of the first sidewall 415 and a second end 421 of the second sidewall 417 (or, conversely, the first end 419 of the first sidewall 415 and the second end 421 of the second sidewall 417 are disposed downstream of the water delivery edge 423). The water delivery edge 423 may be disposed upstream relative to the first end 419 and the second end 421 by a distance in a range of about 0.300 inches to about 0.050 inches, about 0.250 inches to about 0.050 inches, or about 0.200 inches to about 0.100 inches. The arrangement of the water delivery edge 423 relative to the first end 419 of the first sidewall 415 and the second end 421 of the second sidewall 417 facilitate delivering wastewater over the water delivery edge 423 and inhibit wastewater from accumulating on the lower wall 422 upstream of the water delivery edge 423 as detailed further below.

In some embodiments and as illustrated, the water delivery edge 423 may extend linearly between the first sidewall 415 and the second sidewall 417. In other embodiments, the water delivery edge 423 may extend along a curve between the first sidewall 415 and the second sidewall 417. In such embodiments, one or more portions of the water delivery edge 423 may be disposed upstream of the first end 419 of the first sidewall 415 and the second end 421 of the second sidewall 417, and one or more portions of the water delivery edge 423 may be disposed upstream of the first end 419 of the first sidewall 415 and the second end 421 of the second sidewall 417. More specifically, portions of the water delivery edge 423 adjacent to the first sidewall 415 and the second sidewall 417 may be disposed upstream of the first end 419 and the second end 421, and a central portion of the water delivery edge 423 may be disposed downstream of the first end 419 and the second end 421.

Figure 16:
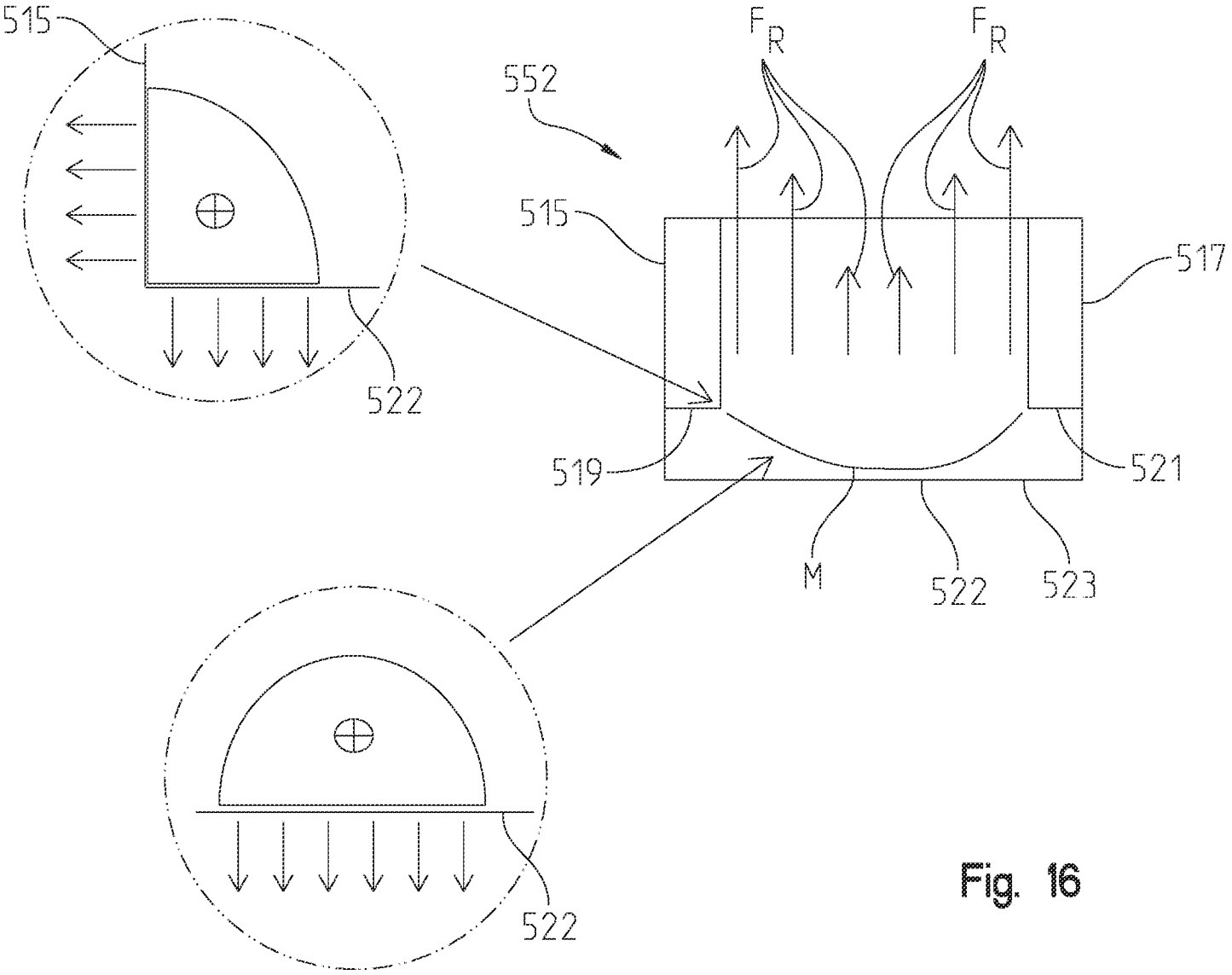
FIG. 16 is a schematic illustration of water interacting with a portion of an illustrative drain receptacle of a vessel rinsing apparatus.
Figure 17:
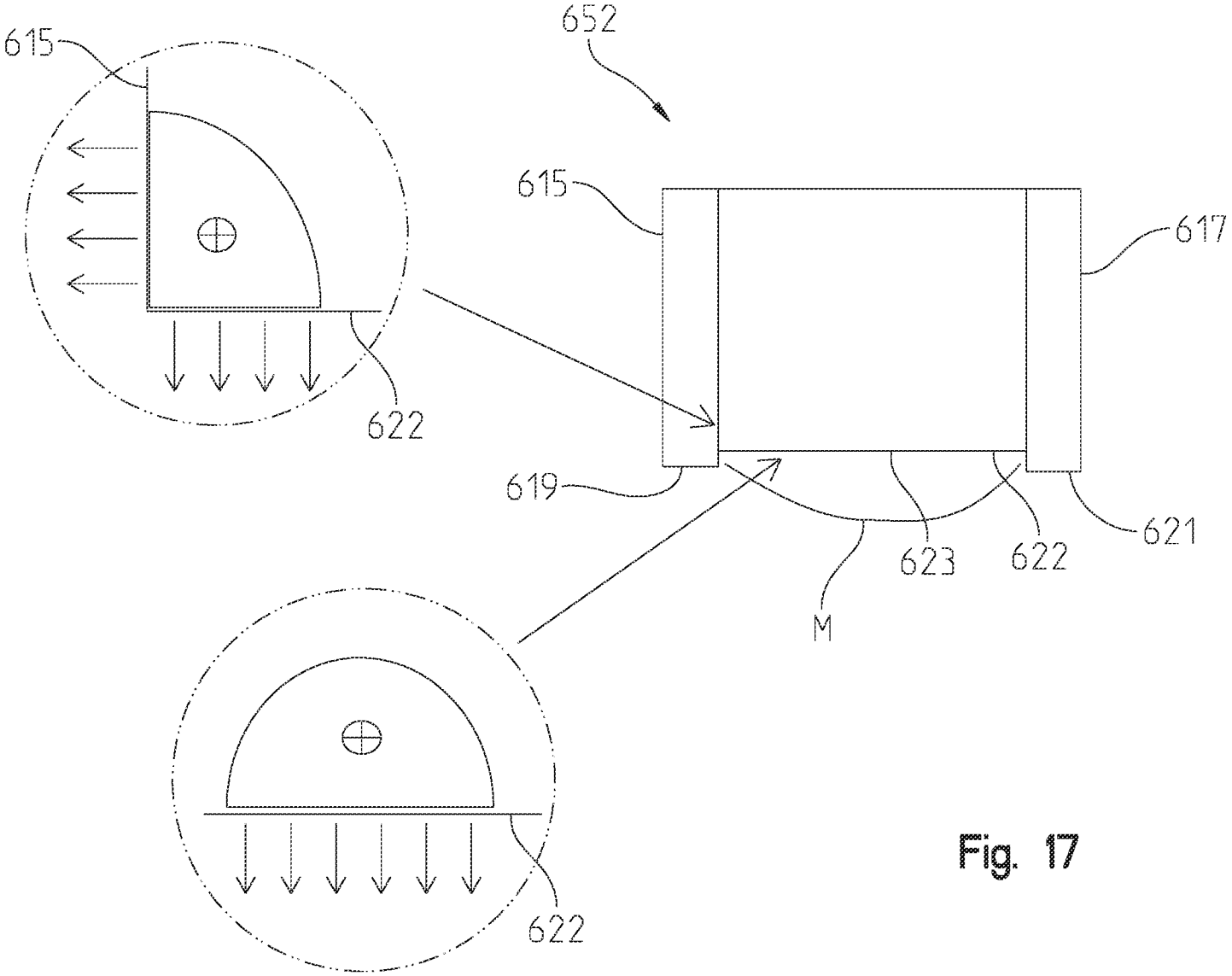
FIG. 17 is a schematic illustration of water interacting with a portion of another illustrative drain receptacle of a vessel rinsing apparatus.

FIG. 16 schematically illustrates water interacting with a portion of a drain receptacle 552 of a vessel rinsing apparatus. The drain receptacle 552 includes a first sidewall 515 having a first end 519, a second sidewall 517 having a second end 521, and a lower wall 522 having a water delivery edge 523. In contrast to the drain receptacle 452, the water delivery edge 523 of the drain receptacle 552 is disposed downstream relative to the first end 519 and the second end 521. Due to the resistance to flow provided by the drain receptacle 552, which decreases proceeding away from both the first sidewall 515 and the second sidewall 517 and is illustrated by arrows $F_R$, water tends to form a meniscus M downstream of the first end 519 and the second end 521 and upstream of the water delivery edge 523 when the apparatus is not in use (that is, after rinsing a vessel). This may cause a relatively large volume of water to accumulate on the lower wall 522. Water would also flow and accumulate in a similar manner if the water delivery edge 523 of the drain receptacle 552 was disposed evenly (that is, neither upstream nor downstream) relative to the first end 519 and the second end 521, although a meniscus would form evenly with the water delivery edge 523. In contrast, FIG. 17 schematically illustrates water interacting with a portion of another drain receptacle 652 of a vessel rinsing apparatus. The drain receptacle 652 may be, for example, the drain receptacle 452 detailed above. The drain receptacle 652 includes a first sidewall 615 having a first end 619, a second sidewall 617 having a second end 621, and a lower wall 622 having a water delivery edge 623. The water delivery edge 623 of the drain receptacle 652 is disposed upstream relative to the first end 619 and the second end 621. In this example, water would tend to form a meniscus M downstream of the water delivery edge 623 when the apparatus is not in use. However, the lower wall 622 is absent in this location, so water instead falls from the drain receptacle 652. Further and as detailed below, water that initially falls from the drain receptacle applies cohesive forces to water on the lower wall 622 and thereby pulls additional water over the water delivery edge 623.

Figure 18:
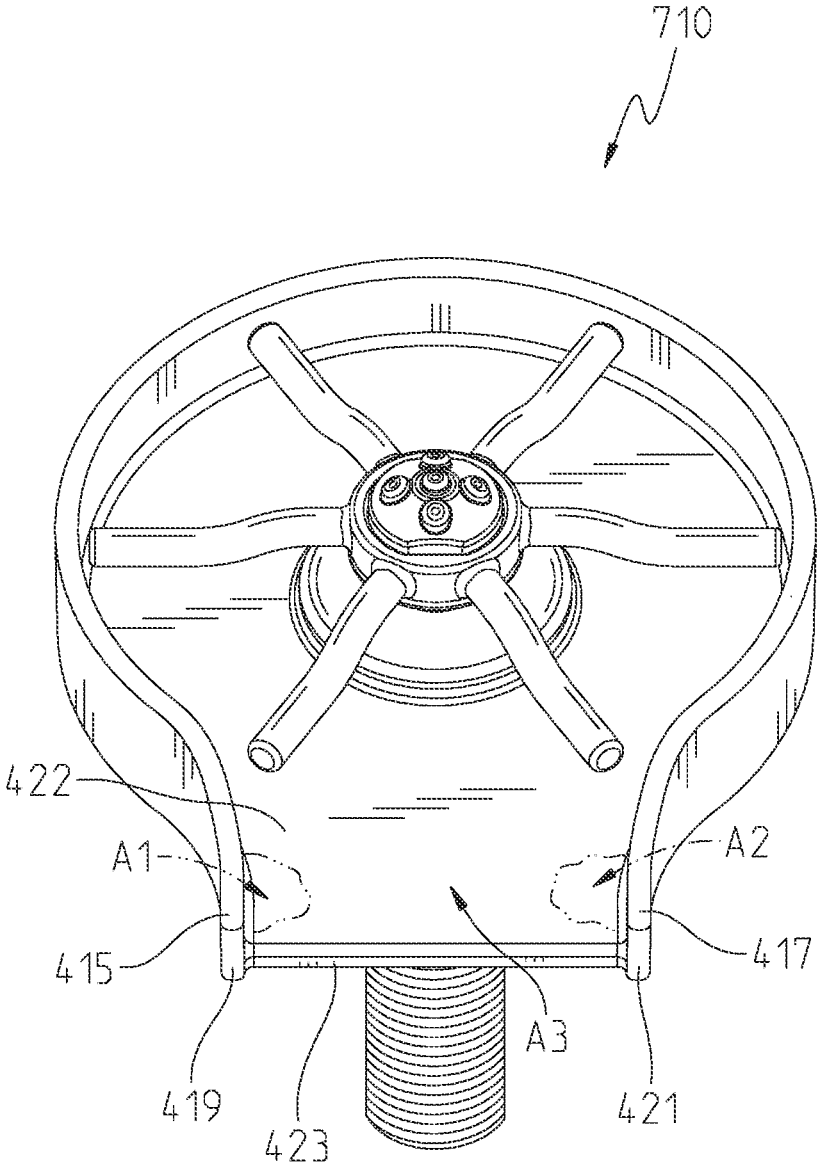
FIG. 18 is a perspective view of an illustrative vessel rinsing apparatus including the drain receptacle of FIG. 15.

FIG. 18 shows an illustrative embodiment of a vessel rinsing apparatus 710 including the drain receptacle 452 and after rinsing a vessel (not shown). Except for the drain receptacle 452, the vessel rinsing apparatus 710 includes many of the same elements as the vessel rinsing apparatus 10 detailed above. In addition, the strainer (shown elsewhere) is omitted for clarity. As illustrated, after rinsing a vessel water may accumulate on the lower wall 422 adjacent the first sidewall 415 and the second sidewall 417 in areas A1 and A2, respectively. However, the upstream position of the water delivery edge 423 relative to the first end 419 of the first sidewall 415 and the second end 421 of the second sidewall 417 inhibits water from accumulating in area A3, which is generally disposed between areas A1 and A2. This occurs because, as detailed above, water would tend to form a meniscus downstream of the water delivery edge 423 and water that initially moves over the water delivery edge 423 applies cohesive forces to water in area A3 and thereby pulls water in area A3 over the water delivery edge 423. In contrast, drain receptacles in which the water delivery edge is not disposed upstream relative to the first end and the second end typically permit water to accumulate in areas A1, A2, and A3.

Figure 19:
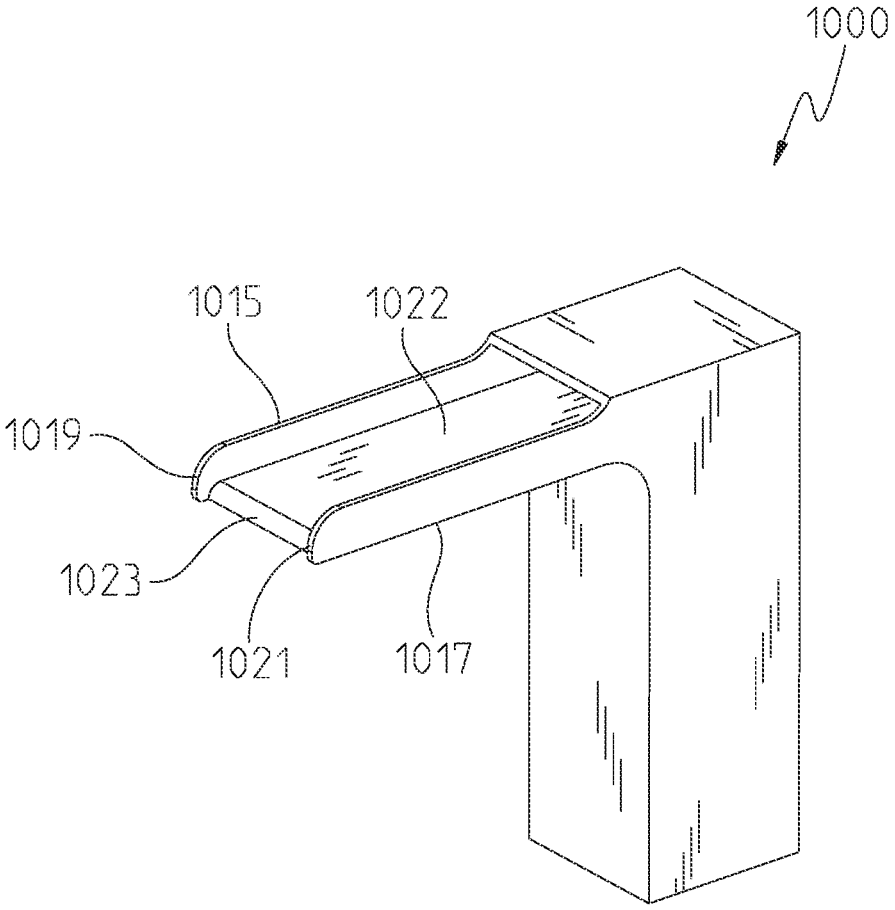
FIG. 19 is a perspective view of an illustrative embodiment of a faucet spout.

In other illustrative embodiments, the drain receptacle 452 may receive wastewater from other types of apparatus. Similarly, features of the drain receptacle 452 may be incorporated in other types of open waterway apparatus, such as waterfall-type faucet spouts. More specifically, an open waterway apparatus, such as a waterfall-type faucet spout 1000 as illustrated in FIG. 19, may include a lower wall 1022, and the lower wall 1022 defines a waterway configured to receive water (for example, from an upstream outlet). The lower wall 1022 also includes a water delivery edge 1023, which is in fluid communication with the waterway and is configured to deliver water thereover. The open waterway apparatus may further include a first sidewall 1015 coupled to the lower wall 1022 on a first side of the waterway, and the first sidewall 1015 includes a first end 1019 disposed downstream of the water delivery edge 1023. The open waterway apparatus may further include a second sidewall 1017 coupled to the lower wall 1022 on a second side of the waterway, and the second sidewall 1017 includes a second end 1021 disposed downstream of the water delivery edge 1023. Such an open waterway apparatus may facilitate delivering water over the water delivery edge 1023 and inhibit water from accumulating upstream of the water delivery edge 1023 as detailed above.

Figure 20:
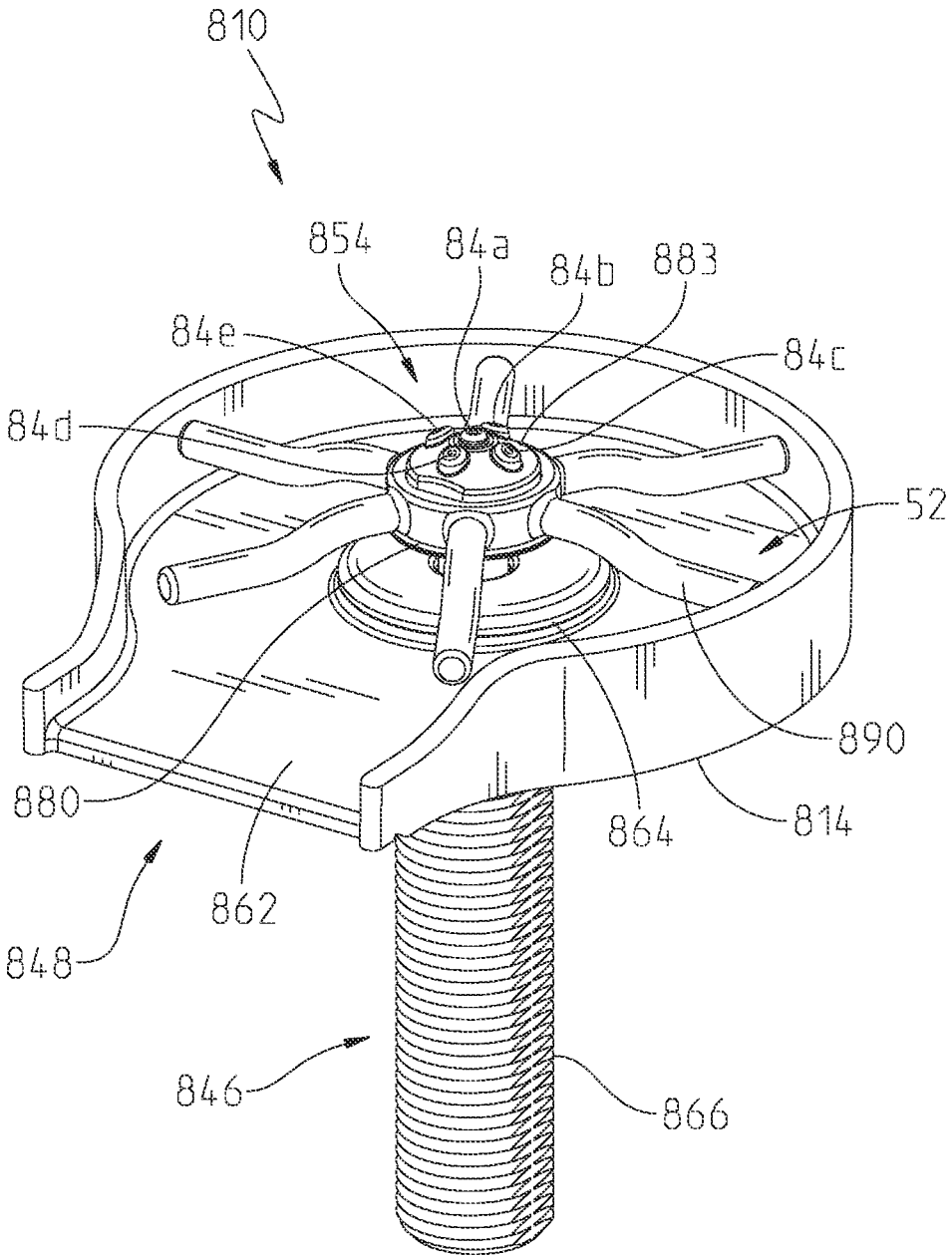
FIG. 20 is a perspective view of another illustrative embodiment of a vessel rinsing apparatus.
Figure 21:
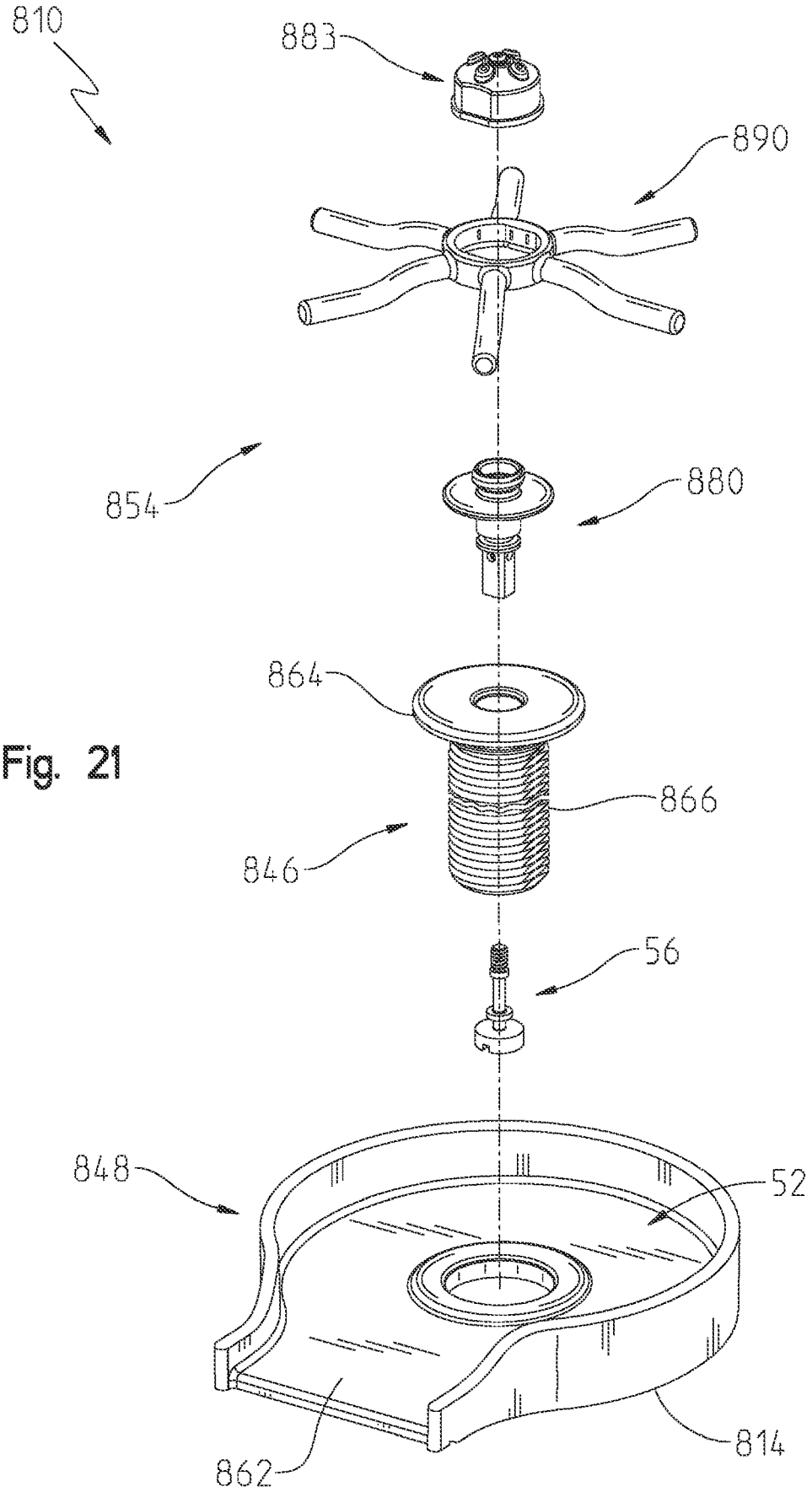
FIG. 21 is a top exploded perspective view of the vessel rinsing apparatus of FIG. 20.

A further illustrative embodiment of a vessel rinsing apparatus 810 is shown in FIGS. 20 and 21 as including many of the same elements as the vessel rinsing apparatus 10 detailed above. As such, in the following description, like components are identified with similar reference numbers. The vessel rinsing apparatus 810 includes a mounting base 846 including a mounting shank 866 and an upper coupler 864. The escutcheon 848 illustratively includes a lower wall 862 and an upwardly extending wall 814 defining the drain bowl 52. The fluid discharge member 854 includes a central body 880 that is partially received in the mounting shank 866 and couples to the valve member 56 (see FIG. 21). The central body 880 may comprise, for example, a polymer or brass. The central body 880 detachably couples to a sprayface or nozzle assembly 883 that includes the plurality of nozzles 84 (see FIG. 20) in fluid communication with the fluid passageway 82. The nozzles 84 may include a center nozzle 84*a* and a plurality of peripheral nozzles 84*b*, 84*c*, 84*d*, 84*e* positioned radially outward from the center nozzle 84*a*.

The nozzle assembly 883 may be particularly suitable for cleaning a specific type of receptacle, and the nozzle assembly 883 may be detached from the central body 880 and replaced by one or more other nozzle assemblies that are particularly suitable for cleaning other specific types of receptacles. For example, a first nozzle assembly may be suitable for rinsing bottles, mugs, glasses, and the like, a second nozzle assembly may be suitable for rinsing wine glasses. One or more of the interchangeable nozzle assemblies may include nozzles that are oriented to direct water in different desired positions within an interior of a receptacle. For example, a center nozzle may be configured to discharge water upwardly, a first peripheral nozzle may be oriented at an angle to direct water to a distal corner of a mug, a second peripheral nozzle may be oriented at an angle to direct water to a distal corner of a highball glass, a third peripheral nozzle may be oriented at an angle to direct water to a distal corner of a tumbler or pint glass, and a fourth peripheral nozzle may be oriented at an angle to direct water to a distal portion of a wine glass. As another example, a center nozzle may be configured to discharge water upwardly, a first peripheral nozzle and a second peripheral nozzle may be oriented at a first angle, and a third peripheral nozzle and a fourth peripheral nozzle may be oriented at a second angle. One or more of the nozzle assemblies may be formed of a material that is relatively easy to clean (for example, to remove hardwater deposits), such as rubber. One or more of the nozzle assemblies may completely comprise a flexible polymer or a relatively rigid base and flexible polymer nozzles.

Figure 22:
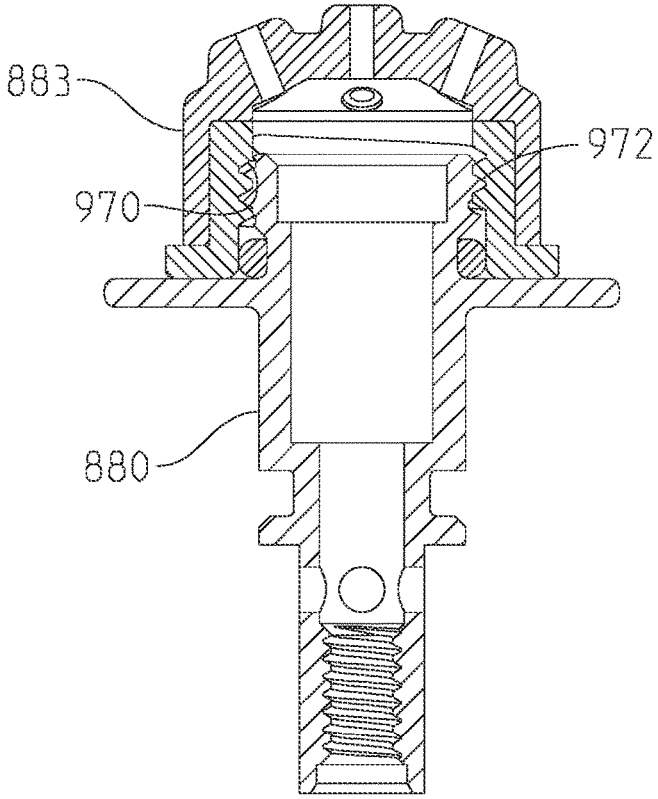
FIG. 22 is a cross-sectional view of a nozzle assembly of the vessel rinsing apparatus of FIG. 20.

With reference to FIG. 22, a cross-sectional view of the nozzle assembly 883 and the central portion 880 is provided. Illustratively, the nozzle assembly 883 includes a first threaded surface 970 for detachably coupling to a second threaded surface 972 of the central portion 880. In addition, the central portion 880 and the mounting shank 866 may include keying features to inhibit relative rotation therebetween (for example, a groove and a protrusion—not shown) when the nozzle assembly 883 is unthreaded from the central portion 880. Alternatively, other features may be used to detachably couple the nozzle assembly 883 to the central portion 880, such as an interference fit or keying features (for example, a groove and a protrusion).

Figure 23:
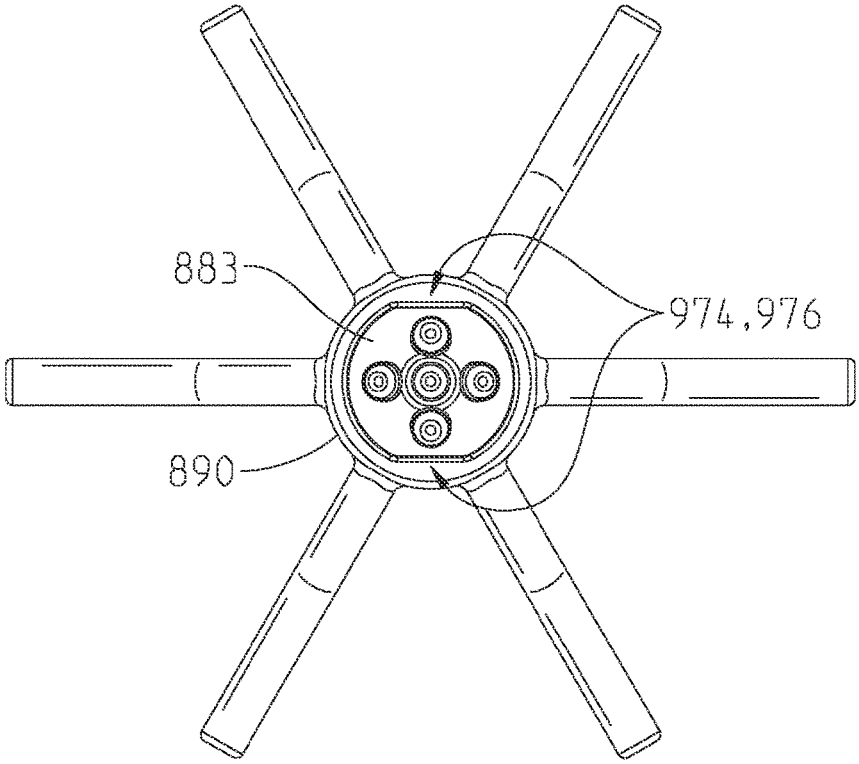
FIG. 23 is a top view of a fluid discharge member including the nozzle assembly of FIG. 22.

With reference to FIG. 23, a top view of the nozzle assembly 883 and a trigger 890 of the fluid discharge member is provided. Illustratively, the nozzle assembly 883 and the trigger 890 include keying features to inhibit relative rotation therebetween (for example and as illustrated, the trigger 890 includes two flat surfaces 974 that engage two flat surfaces 976 of the nozzle assembly 883—alternatively, the nozzle assembly 883 includes two protrusions that are received by two grooves in the trigger 890, or the trigger 890 includes two protrusions that are received by two grooves in the nozzle assembly 883). Accordingly, the trigger 890 may be rotated relative to the mounting shank 866 and the central portion 880 to unthread the nozzle assembly 883 from the central portion 880.

Figure 24:
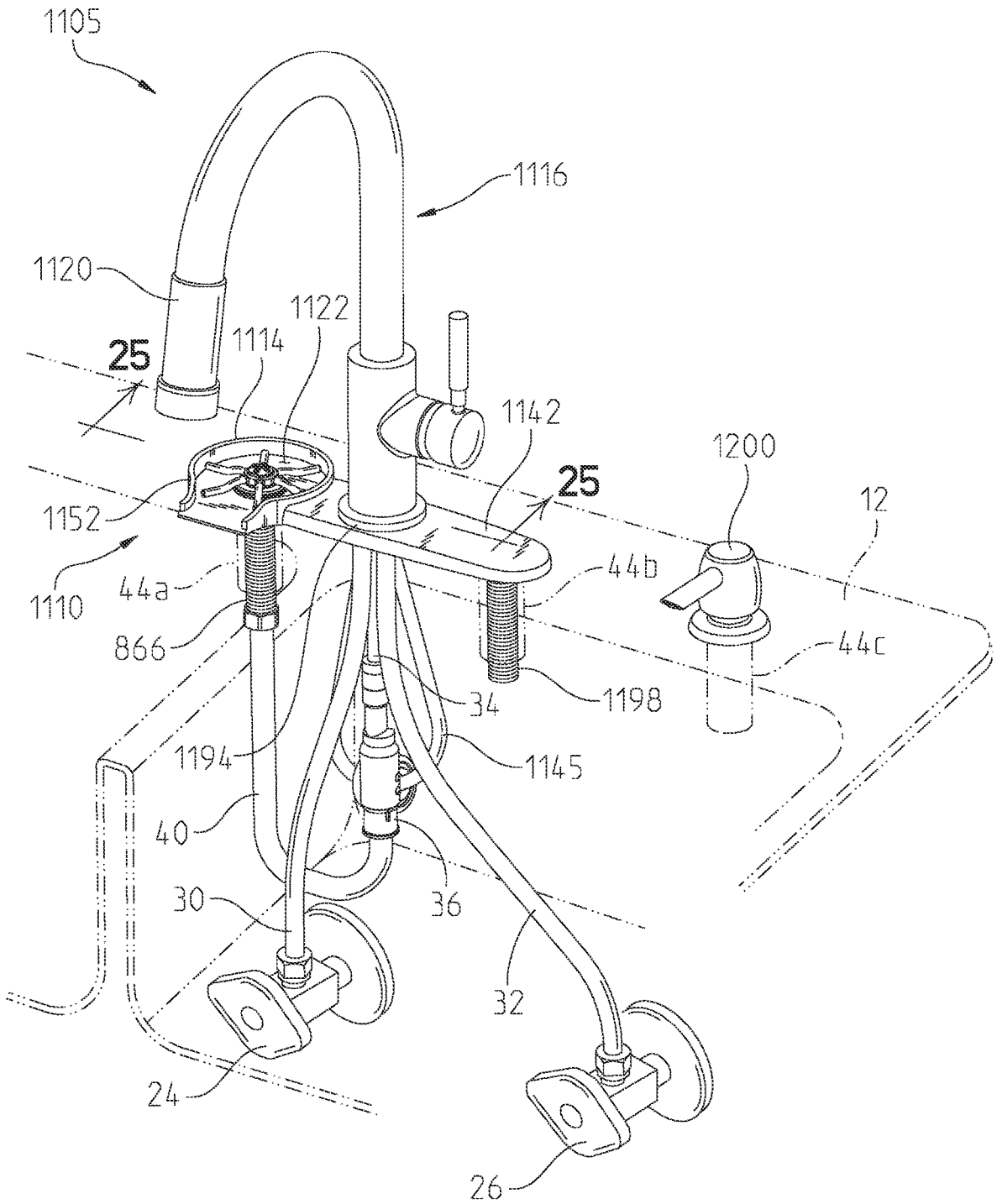
FIG. 24 is a perspective view of an illustrative faucet system mounted to a sink deck and including a faucet and a vessel rinsing apparatus.
Figure 25:
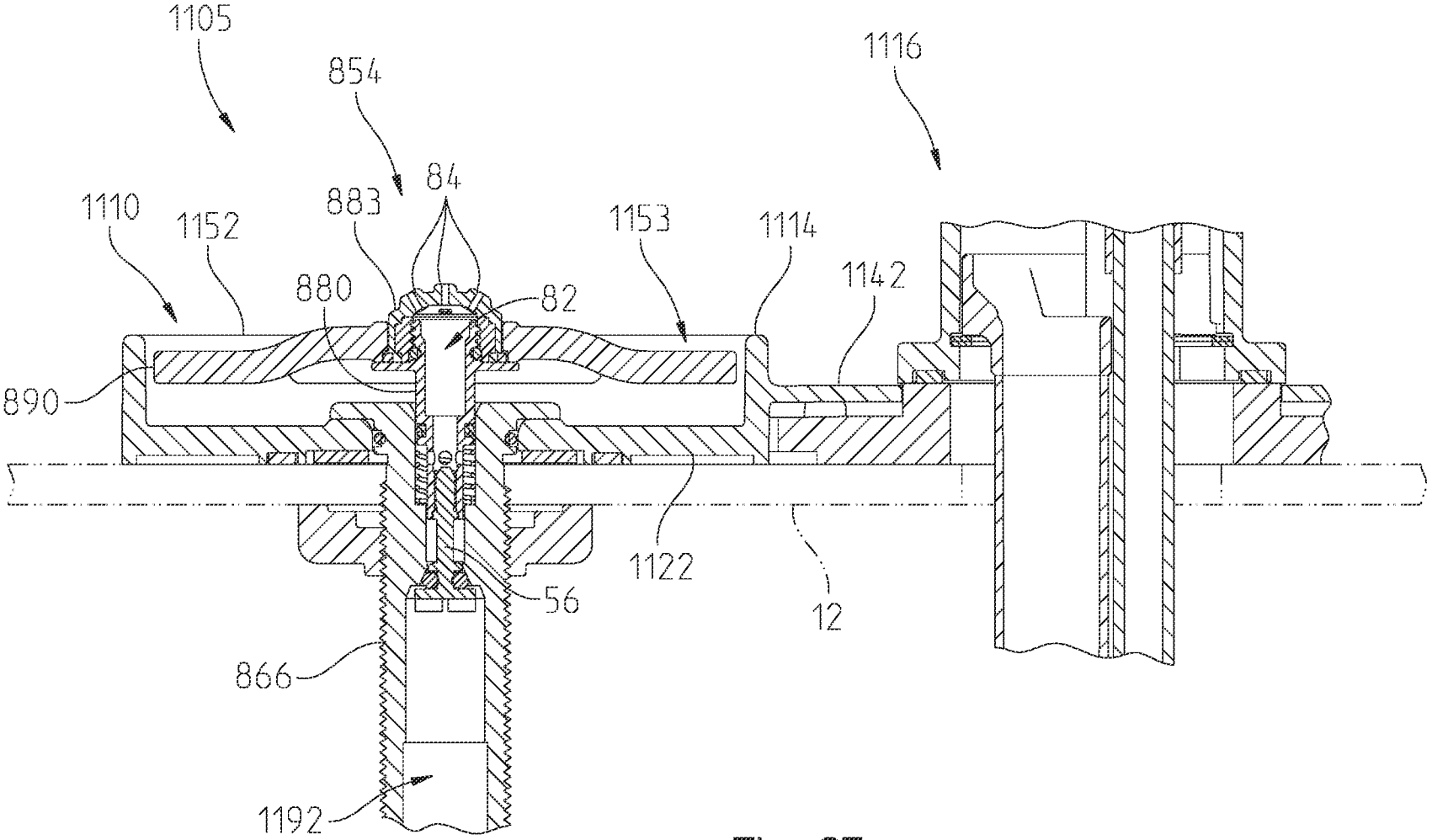
FIG. 25 is a cross-sectional view of the faucet system of FIG. 24.
Figure 26:
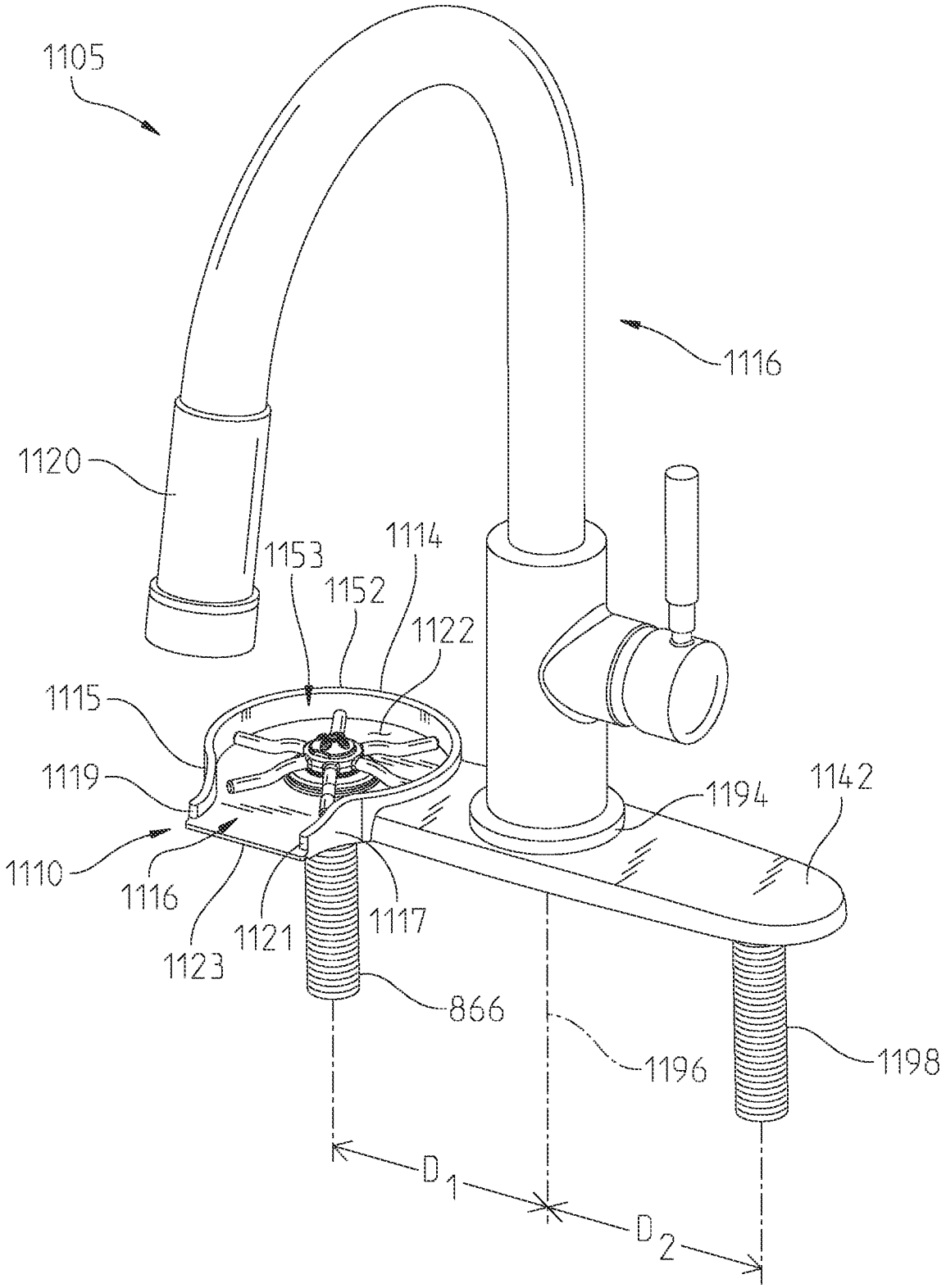
FIG. 26 is another perspective view of the faucet system of FIG. 24.

FIGS. 24-26 show an illustrative embodiment of a faucet system 1105 as being coupled to the sink deck 12 and the water supplies 24 and 26 via the water tubes 30, 32, 34, 38 (shown elsewhere), and 40, and the diverter valve 36 as described above. The faucet system 1105 includes a vessel rinsing apparatus 1110 and a faucet 1116, which include many of the same elements as the vessel rinsing apparatus 710 and the faucet 16 detailed above, respectively. As such, in the following description, like components are identified with similar reference numbers. In contrast to the components described above, however, the vessel rinsing apparatus 1110 and the faucet 1116 are generally provided as a common structure. More specifically, the faucet 1116 includes an escutcheon 1142 that may be positioned intermediate the sink deck 12 and a delivery spout 1120 (illustratively, a pull-out delivery spout 1120 including an extension conduit 1145— see FIG. 24), generally as described above. The escutcheon 1142 also couples to a drain receptacle 1152 of the vessel rinsing apparatus 1110. More specifically, the escutcheon 1142 may monolithically couple to, or be integrally formed with, the drain receptacle 1152 of the vessel rinsing apparatus 1110. Even more specifically and as illustrated in FIG. 25, the escutcheon 1142 may be monolithically couple to an upwardly extending wall 1114 of the drain receptacle 1152, and the upwardly extending wall 1114 may monolithically couple to the lower wall 1122 of the drain receptacle 1152.

Referring specifically to FIG. 26, the drain receptacle 1152 of the vessel rinsing apparatus 1110 may otherwise be similar to the drain receptacle 452 described above. More specifically, the lower wall 1122 and the upwardly extending wall 1114 together define a receiving portion 1153 or volume for receiving wastewater from a vessel rinsed by the vessel rinsing apparatus 1110. The lower wall 1122 and a first sidewall 1115 and a second sidewall 1117 of the upwardly extending wall 1114 define a drain channel 1116 in fluid communication with the receiving portion 1153. The lower wall 1122 also includes a water delivery edge 1123 in fluid communication with the drain channel 1116. The water delivery edge 1123 is configured to deliver water thereover. In contrast to the drain receptacle 452, however, the water delivery edge 1123 is illustratively disposed downstream relative to a first end 1119 of the first sidewall 1115 and a second end 1121 of the second sidewall 1117. Alternatively, the water delivery edge 1123 may be disposed upstream relative to the first end 1119 of the first sidewall 1115 and the second end 1121 of the second sidewall 1117.

Referring specifically to FIG. 25, the remaining features of the vessel rinsing apparatus 1110 may be similar to or the same as those of the vessel rinsing apparatus 810 described above. More specifically, the fluid discharge member 854 includes the central body 880, which is partially received in a passageway 1192 of the mounting shank 866 and couples to the valve member 56. The central body 880 detachably couples to the sprayface or nozzle assembly 883 that includes the plurality of nozzles 84 in fluid communication with the fluid passageway 82 of the central body 880. In addition, the trigger 890 extends outwardly from the nozzle assembly 883 and the central body 880.

As illustrated in FIGS. 24-26, the mounting shank 866 is shared between the vessel rinsing apparatus 1110 and the faucet 1116. Stated in a similar way, the mounting shank 866 generally occupies the position that would be occupied by one of the mounting shanks of a conventional faucet 1116 including two mounting shanks positioned on opposite sides of a spout 1120 (that is, a "three-hole installation" faucet 1116). Stated in another similar way, the mounting shank 866 coupled to the vessel rinsing apparatus 1110 extends through the first mounting aperture 44*a* of the sink deck 12 (FIG. 24), and the mounting shank 866 is disposed apart from a base 1194 of the spout 1120, or a longitudinal or central axis 1196 (FIG. 26) of the spout 1120, by a first horizontal distance D1. A second mounting shank 1198 is coupled to the escutcheon 1142, and the second mounting shank 1198 is configured to extend through the second mounting aperture 44*b* of the sink deck 12. The second mounting shank 1198 is disposed apart from the base 1194 of the spout 1120, or the longitudinal or central axis 1196 of the spout 1120, by a second horizontal distance D2, which is substantially equal to the first horizontal distance D1 (that is, equal±10 percent). As illustrated in FIG. 24, the shared mounting shank 866 may advantageously permit the third mounting aperture 44*c* of the sink deck 12 to receive a different device or component, such as the illustrated soap dispenser 1200.

Figure 27:
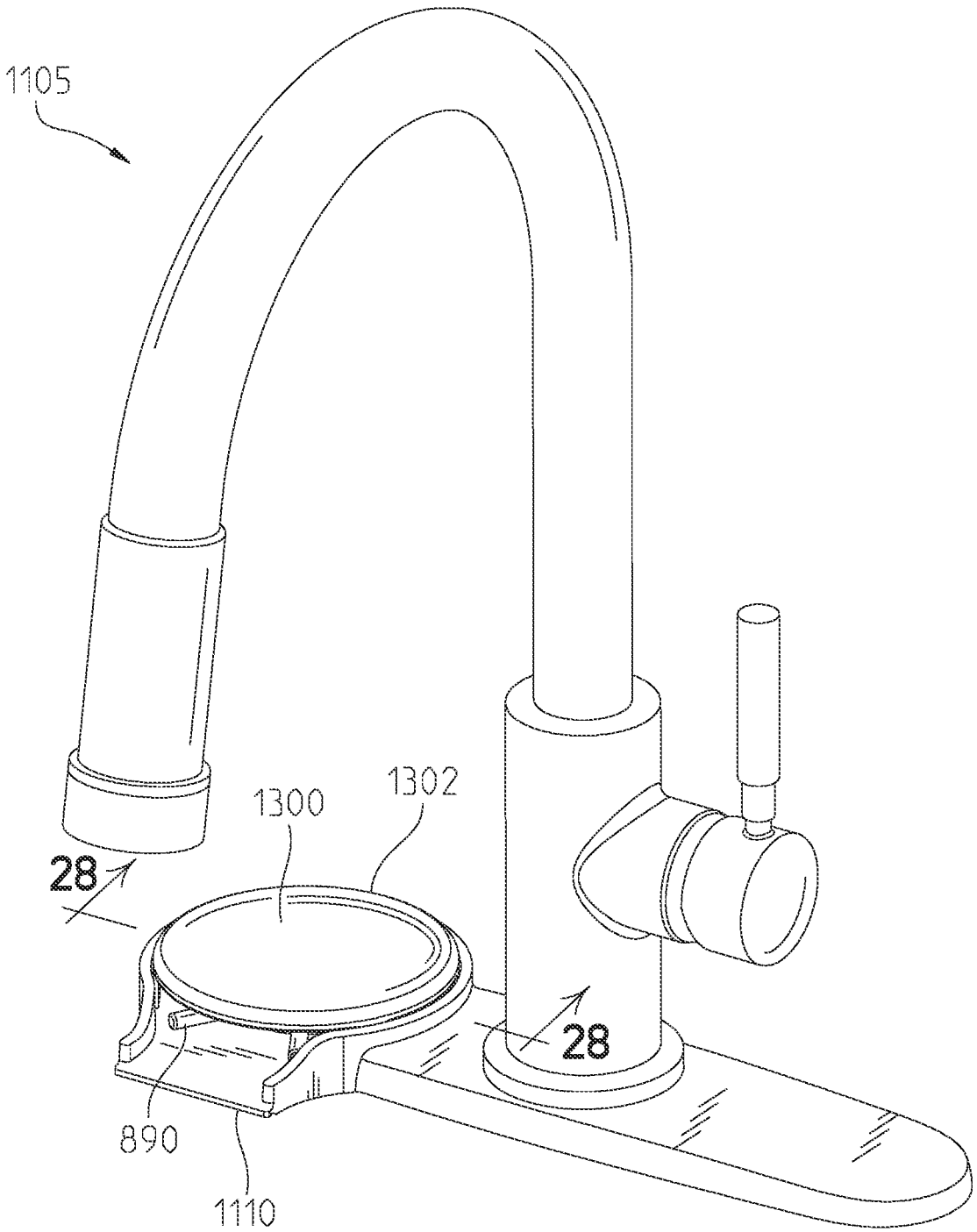
FIG. 27 is a perspective view of the faucet system of FIG. 24 with a detachable cap obscuring the vessel rinsing apparatus.
Figure 28:
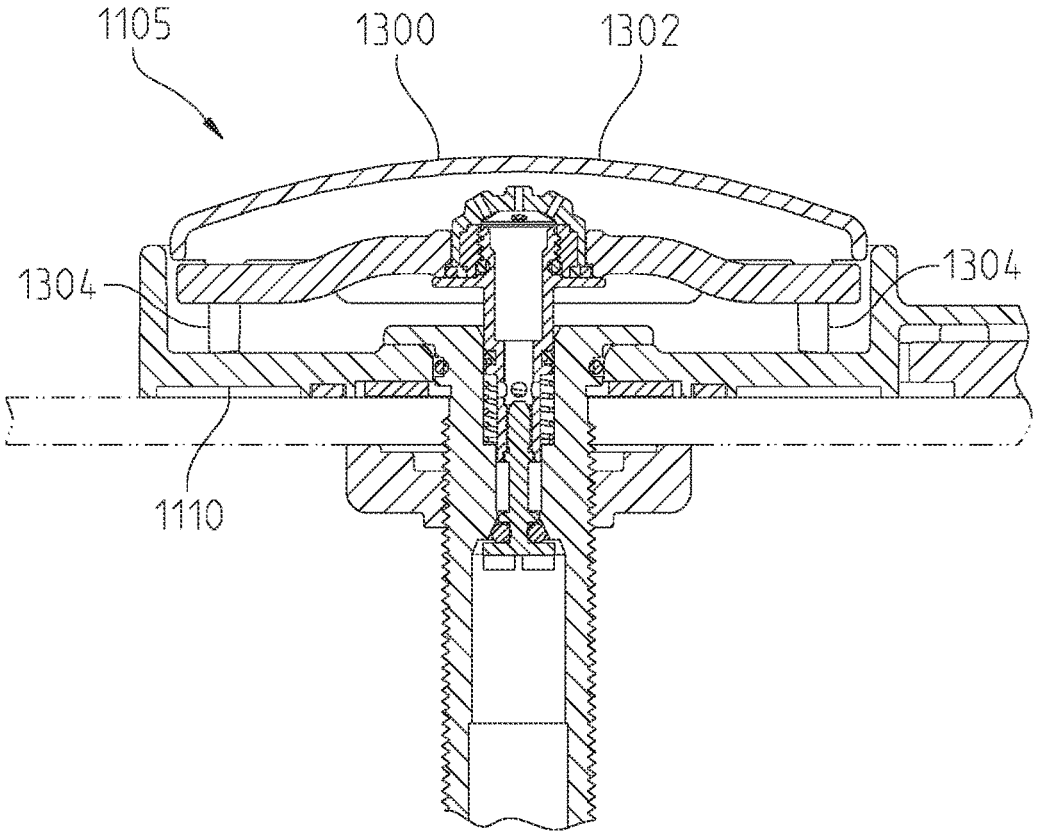
FIG. 28 is a cross-sectional view of the faucet system and the detachable cap of FIG. 27.
Figure 29:
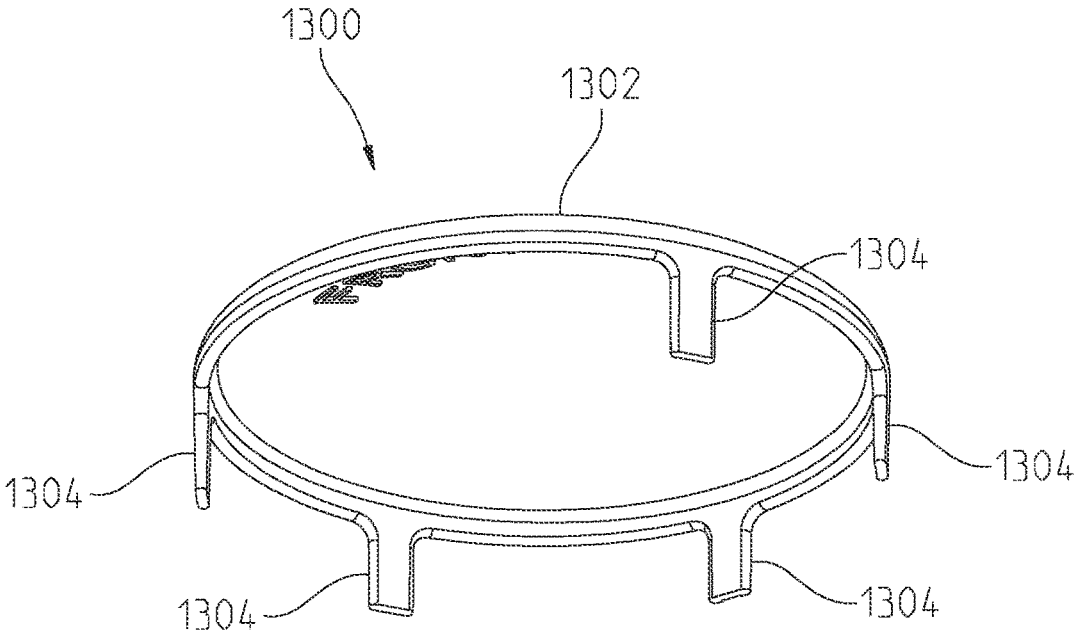
FIG. 29 is a perspective view of the detachable cap of FIG. 27.

FIGS. 27 and 28 illustrate the faucet system 1105 and a cap 1300 that detachably couples to and selectively overlies or obscures a portion of the vessel rinsing apparatus 1110, and FIG. 29 illustrates the cap 1300 detached from the vessel rinsing apparatus 1110. In some embodiments and as illustrated, the cap 1300 includes a main body 1302 that selectively obscures the trigger 890 and the nozzle assembly 883 (shown elsewhere) of the vessel rinsing apparatus 1110. In some embodiments and as illustrated specifically in FIGS. 28 and 29, the main body 1302 of the cap 1300 couples to a plurality of downwardly extending feet 1304. As illustrated, the feet 1304 may engage the lower wall 1122 of the vessel rinsing apparatus 1110 to inhibit downward motion of the cap 1300 relative to the vessel rinsing apparatus 1110. As a result, the cap 1300 inhibits actuation of the trigger 890 and water delivery from the nozzle assembly 883. The cap 1300 may be formed of any of various appropriate materials, including polymers, metals, and the like.

Figure 30:
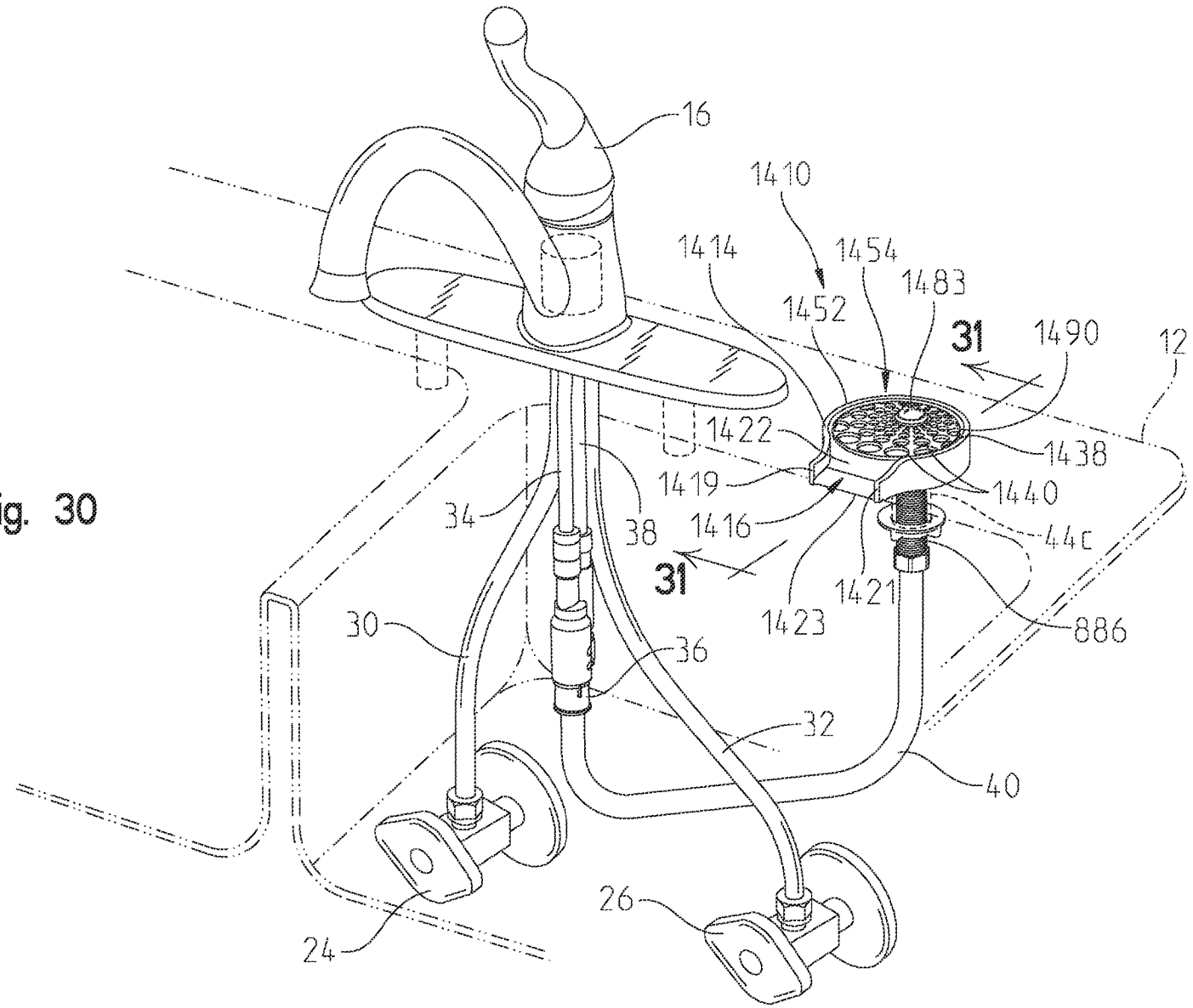
FIG. 30 is a perspective view of another illustrative vessel rinsing apparatus mounted to a sink deck and fluidly coupled to a faucet.
Figure 31:
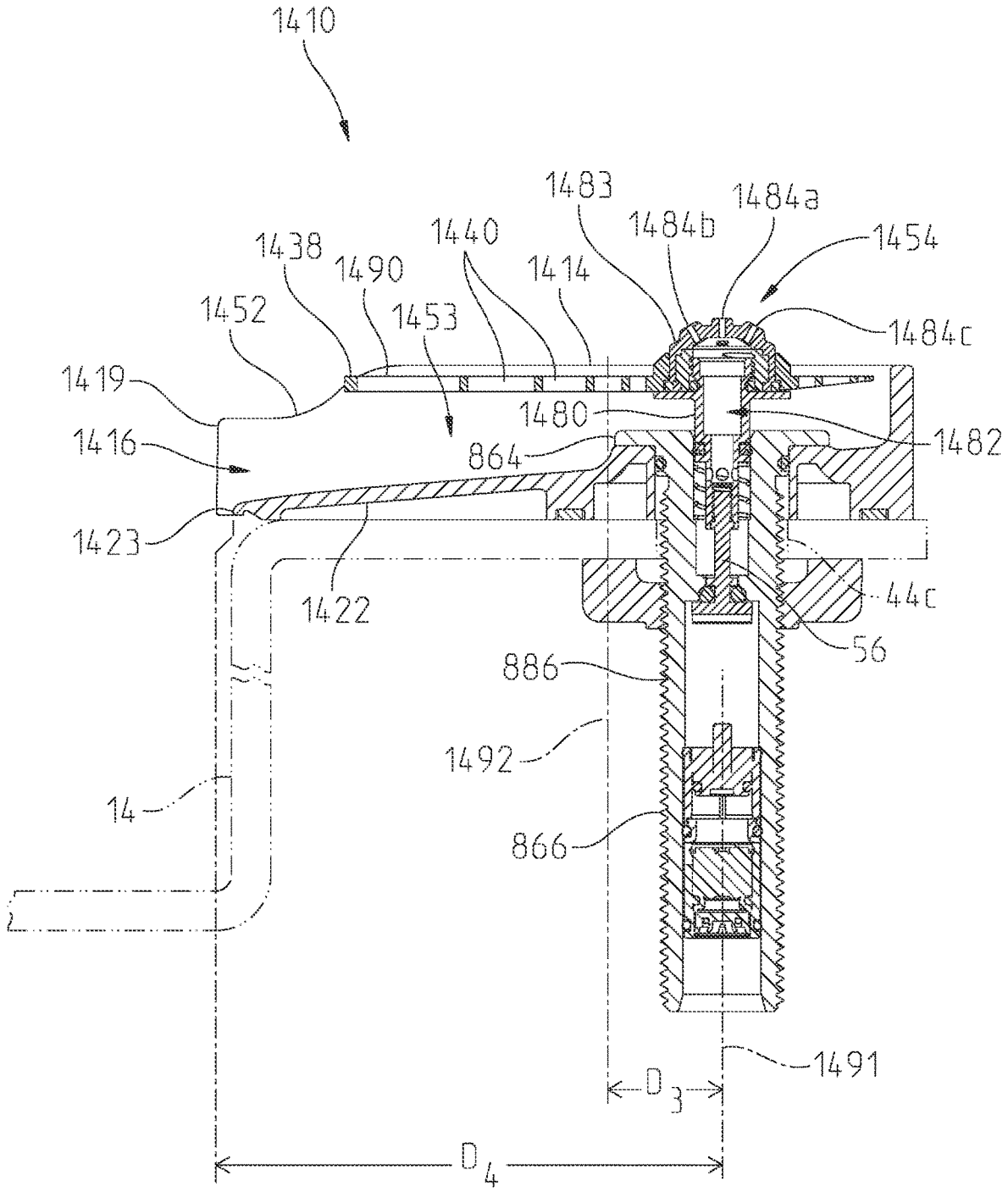
FIG. 31 is a cross-sectional view of the vessel rinsing apparatus of FIG. 30.

In various embodiments, including, for example, the embodiments described above, vessel rinsing apparatus may include sprayfaces or nozzle assemblies disposed substantially concentrically relative to receiving portions of drain receptacles. In other embodiments, sprayfaces or nozzle assemblies may be disposed eccentrically relative to receiving portions of drain receptacles. As a specific example, FIGS. 30-31 show an illustrative embodiment of a vessel rinsing apparatus 1410 and the faucet 16 as being coupled to the sink deck 12 and the water supplies 24 and 26 via the water tubes 30, 32, 34, 38 (shown elsewhere), and 40, and the diverter valve 36 as described above. The vessel rinsing apparatus 1410 is shown as including many of the same elements of the vessel rinsing apparatus 810 described above. As such, in the following description, like components are identified with similar reference numbers. Referring primarily to FIG. 31, the vessel rinsing apparatus 1410 includes the mounting base 886, which includes the mounting shank 866 and the upper coupler 864. The mounting base 886 illustratively carries a flow regulator 1486 and a check valve 1488. The mounting base 886 couples to a drain receptacle 1452, which includes a lower wall 1422 and an upwardly extending wall 1414. The walls 1414 and 1422 together define a generally circular receiving portion 1453 or volume for receiving wastewater from a vessel rinsed by the vessel rinsing apparatus 1410. The walls 1414 and 1422 also together define a drain channel 1416 in fluid communication with the receiving portion 1453. The lower wall 1422 also includes a water delivery edge 1423 in fluid communication with the drain channel 1416. The water delivery edge 1423 is configured to deliver water thereover. As illustrated, the water delivery edge 1423 may be disposed upstream relative to a first end 1419 and a second end 1421 of the upwardly extending wall 1414. Alternatively, the water delivery edge 1423 may be disposed downstream relative to the first end 1419 and the second end 1421 of the upwardly extending wall 1414.

A fluid discharge member 1454 includes a central body 1480 that is partially received in the mounting shank 866 and couples to the valve member 56. The central body 1480 couples to a sprayface or nozzle assembly 1483 that includes the plurality of nozzles 1484 in fluid communication with a fluid passageway 1482. The nozzles 1484 may include a center nozzle 1484*a* and a plurality of peripheral nozzles, two of which are identified in FIG. 31 as 1484*b* and 1484*c*, positioned radially outward from the center nozzle 1484*a*. The central body 1480 and the nozzle assembly 1483 also couple to a trigger 1490. As illustrated, the trigger 1490 may be a strainer including a base 1438 and a plurality of drain openings 1440.

The nozzle assembly 1483, the central body 1480, and the mounting base 886 are disposed eccentrically relative to the receiving portion 1453 of the drain receptacle 1452. Stated another way, the central axis 1491 of the nozzle assembly 1483, the central body 1480, and the mounting base 886 are disposed apart or offset from the central axis 1492 of the receiving portion 1453 as viewed from above or the side. Such an offset (identified in FIG. 31 as dimension D3) may be, for example, about 0.75 inches (that is, 0.75 inches±10 percent). As illustrated, the eccentric disposition of the nozzle assembly 1483, the central body 1480, and the mounting base 886 relative to the receiving portion 1453 may facilitate positioning the water delivery edge 1423 proximate the sink basin 14 (depending on the disposition of the mounting aperture 44*c* relative to the sink basin 14). Similarly, in some embodiments the nozzle assembly 1483, the central body 1480, and the mounting base 886 are disposed eccentrically relative to the receiving portion 1453 to provide a specific offset between the nozzle assembly 1483, the central body 1480, and the mounting base 886 and the water delivery edge 1423 (identified in FIG. 31 as dimension D4). Such an offset may be, for example, about 3.25 inches (that is, 3.25 inches±10 percent). In some embodiments and as illustrated, the nozzle assembly 1483, the central body 1480, and the mounting base 886 are also disposed eccentrically relative to the trigger 1490.

Figure 32:
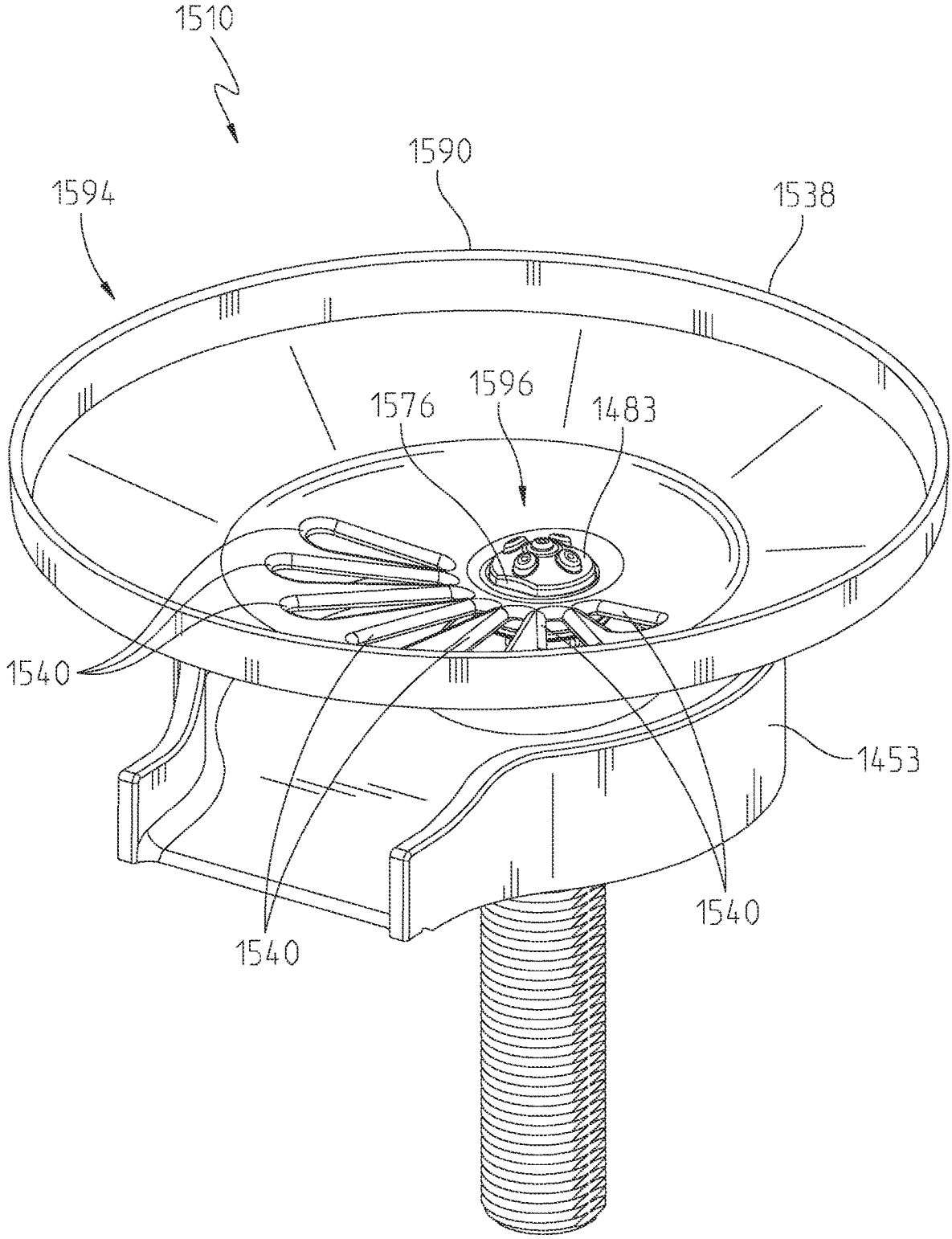
FIG. 32 is a perspective view of yet another illustrative vessel rinsing apparatus.
Figure 33:
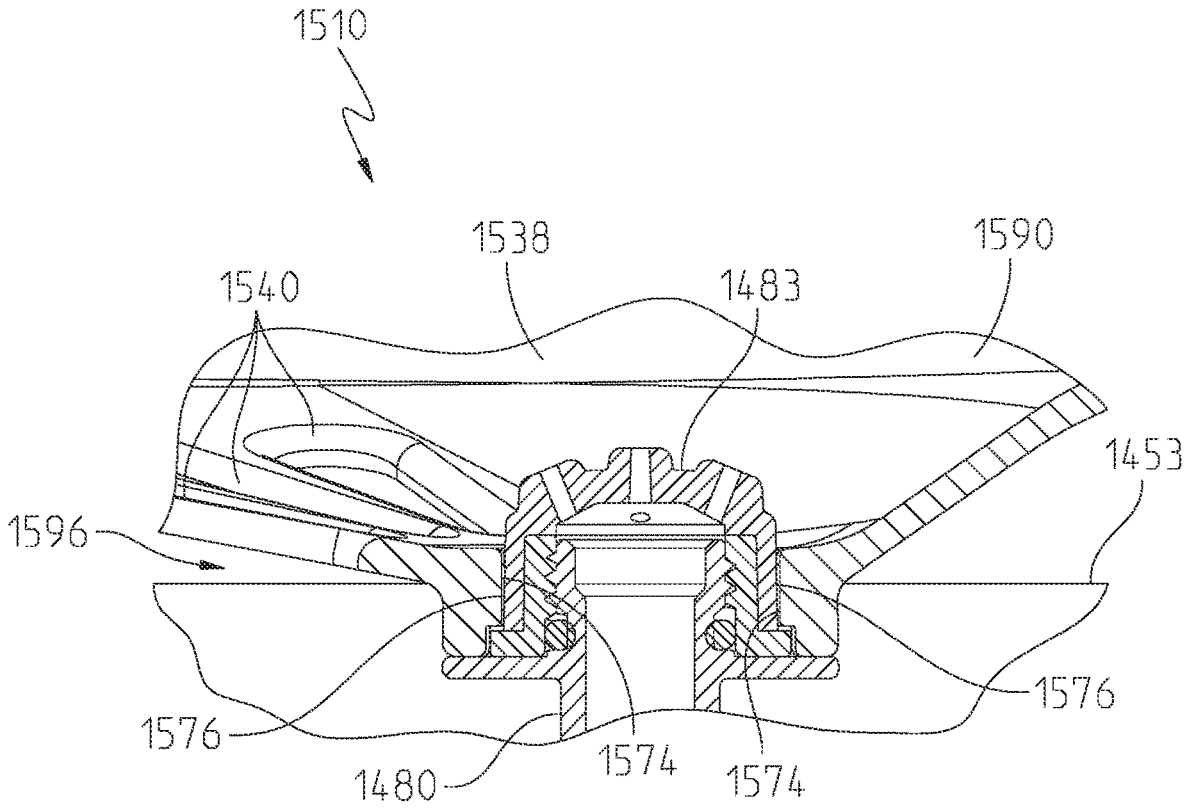
FIG. 33 is a partial cross-sectional view of the vessel rinsing apparatus taken along line 32-32 of FIG. 32.
Figure 34:
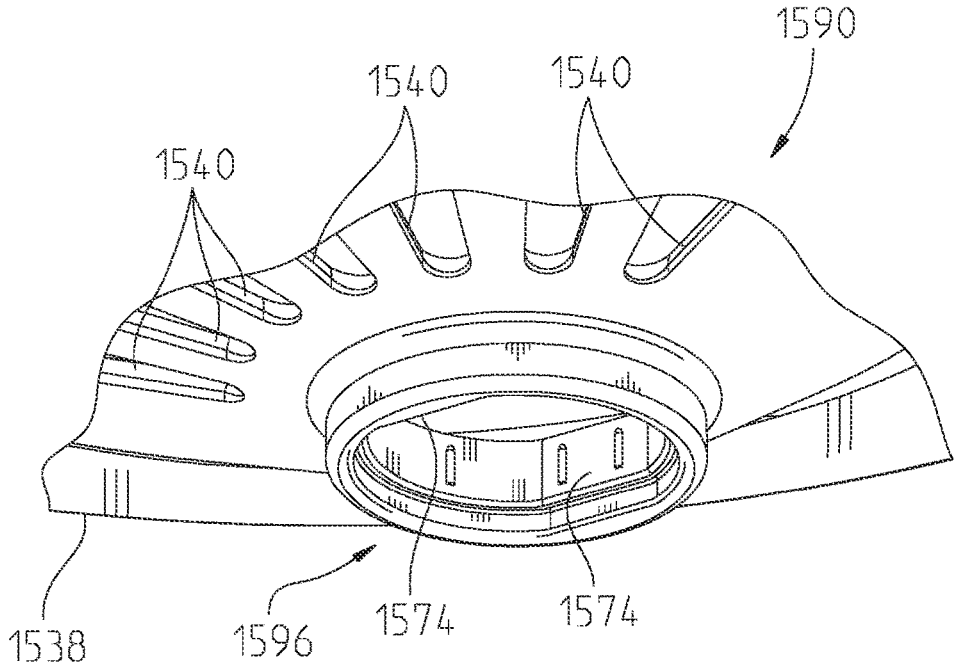
FIG. 34 is a partial bottom perspective view of a trigger of the vessel rinsing apparatus of FIG. 32.

FIGS. 32-33 show an illustrative embodiment of a vessel rinsing apparatus 1510, and FIG. 34 shows a trigger 1590 of the vessel rinsing apparatus 1510. The vessel rinsing apparatus 1510 is shown as including many of the same elements of the vessel rinsing apparatus 1410 described above. As such, in the following description, like components are identified with similar reference numbers.

Referring primarily to FIG. 32, the trigger 1590 is relatively large to facilitate rinsing relatively large vessels (for example, bowls, relatively large glasses, and the like). The trigger 1590 may be used instead of or interchangeably with the trigger 1490 (shown elsewhere). As illustrated, the trigger 1590 may be a tapering strainer, or a funnel, including a base 1538 and a plurality of drain openings 1540. As illustrated, the trigger 1590 may taper inwardly proceeding from an upper portion 1594 to an opposite lower portion 1596. The upper portion 1594 may have a size (for example, a diameter) that is larger than a size (for example, a diameter) of the receiving portion 1453 of the vessel rinsing apparatus 1510. In some embodiments and as illustrated, the trigger 1590 is eccentrically disposed relative to the nozzle assembly 1483 and concentrically relative to the receiving portion 1453. In other embodiments, the trigger 1590 may be concentrically disposed relative to the nozzle assembly 1483 and eccentrically relative to the receiving portion 1453, or concentrically disposed relative to both the nozzle assembly 1483 and the receiving portion 1453.

In some embodiments and as illustrated, the plurality of drain openings 1540 may be disposed to one side of and extend generally away from the nozzle assembly 1483, particularly if the nozzle assembly 1483 is disposed eccentrically relative to the receiving portion 1453. In other embodiments, the plurality of drain openings 1540 may have other arrangements. As a specific example, the plurality of drain openings 1540 may be disposed on both sides of and extend generally away from the nozzle assembly 1483, particularly if the nozzle assembly 1483 is disposed concentrically relative to the receiving portion 1453 (in a similar manner, for example, to the vessel rinsing apparatus 10, the vessel rinsing apparatus 210, the vessel rinsing apparatus 310, the vessel rinsing apparatus 710, the vessel rinsing apparatus 810, the vessel rinsing apparatus 1110, or the vessel rinsing apparatus 1410). In some embodiments and as illustrated, the trigger 1590 and the nozzle assembly 1483 include keying features to inhibit relative rotation therebetween (for example and as illustrated, the trigger 1590 includes two flat surfaces 1574 (see FIGS. 33 and 34) that engage two flat surfaces 1576 of the nozzle assembly 1483 (see FIGS. 32 and 33)— alternatively, the nozzle assembly 1483 includes two protrusions that are received by two grooves in the trigger 1590, or the trigger 1590 includes two protrusions that are received by two grooves in the nozzle assembly 1483). Accordingly, the trigger 1590 may be rotated relative to the central portion 1480 (see FIG. 33) to unthread the nozzle assembly 1483 from the central portion 1480.

Although the invention has been described in detail with reference to certain preferred embodiments, variations and modifications exist within the spirit and scope of the invention as described and defined in the following claims.

The invention claimed is:

1. A drain receptacle for a vessel rinsing apparatus, the drain receptacle comprising:

a receiving portion;

an upwardly extending wall comprising a first end and a second end; and a lower wall coupled to the upwardly extending wall, the lower wall and the upwardly extending wall together defining a drain channel in fluid communication with the receiving portion, the lower wall comprising a water delivery edge in fluid communication with the drain channel and being a free edge configured to deliver water thereover, the water delivery edge being disposed upstream relative to the first end and the second end of the upwardly extending wall.

2. The drain receptacle of claim 1, wherein the water delivery edge comprises a curved shape.

3. The drain receptacle of claim 1, wherein the water delivery edge is disposed upstream relative to the first end and the second end by a distance in a range of about 0.250 inches to about 0.050 inches.

4. The drain receptacle of claim 1, wherein the water delivery edge is disposed upstream relative to the first end and the second end by a distance in a range of about 0.200 inches to about 0.100 inches.

5. A faucet assembly configured to be coupled to a mounting deck, the mounting deck comprising a first mounting aperture and a second mounting aperture, and the mounting deck supporting a sink basin, the faucet assembly comprising:

a faucet, comprising:

an escutcheon configured to be supported above the mounting deck;

a faucet spout coupled to the escutcheon and configured to discharge water therefrom, the faucet spout having a central axis;

a vessel rinsing apparatus coupled to the faucet, comprising:

a drain receptacle comprising:

a receiving portion configured to receive water;

an upwardly extending wall comprising a first end and a second end;

a lower wall coupled to the upwardly extending wall, the lower wall and the upwardly extending wall together defining a drain channel in fluid communication with the receiving portion, the lower wall comprising a water delivery edge in fluid communication with the drain channel and configured to deliver water thereover;

a fluid discharge member including a central body supporting a plurality of nozzles and a trigger extending outwardly from the central body, the trigger being movable relative to the drain receptacle;

a valve operably coupled to the fluid discharge member and configured to move with the trigger to control water flow through the central body to the plurality of nozzles;

a first mounting shank coupled to the vessel rinsing apparatus and configured to extend through the first mounting aperture of the mounting deck, the first mounting shank being disposed apart from the central axis of the faucet spout by a first distance; and a second mounting shank coupled to the escutcheon and configured to extend through the second mounting aperture of the mounting deck, the second mounting shank being disposed apart from the central axis of the faucet spout by a second distance, the second distance being substantially equal to the first distance.

6. The faucet assembly of claim 5, wherein the second mounting shank comprises a passageway, the valve being disposed in the passageway, and the passageway being configured to deliver water to the fluid discharge member.

7. The faucet assembly of claim 5, wherein the water delivery edge is disposed upstream relative to the first end and the second end of the upwardly extending wall.

8. A faucet assembly configured to be coupled to a mounting deck, the mounting deck supporting a sink basin, the faucet assembly comprising:

a faucet, comprising:

an escutcheon configured to be supported above the mounting deck;

a faucet spout coupled to the escutcheon and configured to discharge water therefrom;

a vessel rinsing apparatus, comprising:

a drain receptacle monolithically coupled to the escutcheon, the drain receptacle comprising:

a receiving portion configured to receive water;

an upwardly extending wall comprising a first end and a second end;

a lower wall coupled to the upwardly extending wall, the lower wall and the upwardly extending wall together defining a drain channel in fluid communication with the receiving portion, the lower wall comprising a water delivery edge in fluid communication with the drain channel and configured to deliver water thereover;

a fluid discharge member including a central body supporting a plurality of nozzles and a trigger extending outwardly from the central body, the trigger being movable relative to the drain receptacle; and a valve operably coupled to the fluid discharge member and configured to move with the trigger to control water flow through the central body to the plurality of nozzles.

9. The faucet assembly of claim 8, wherein the water delivery edge is disposed upstream relative to the first end and the second end of the upwardly extending wall.

10. A drain receptacle for a vessel rinsing apparatus, the drain receptacle comprising:

a receiving portion;

a base comprising a water delivery edge in fluid communication with the receiving portion and being a free edge configured to deliver water thereover; and an upwardly extending wall coupled to the base, the upwardly extending wall comprising:

a first end disposed on a first side and downstream of the water delivery edge; and a second end disposed on a second side and downstream of the water delivery edge.

11. The drain receptacle of claim 10, wherein the water delivery edge comprises a curved shape.

12. The drain receptacle of claim 10, wherein the first end and the second end are disposed downstream relative to the water delivery edge by a distance in a range of about 0.250 inches to about 0.050 inches.

13. The drain receptacle of claim 10, wherein the first end and the second end are disposed downstream relative to the water delivery edge by a distance in a range of about 0.200 inches to about 0.100 inches.

14. A drinkware rinsing apparatus configured to be installed on a mounting deck adjacent a sink basin, the rinsing apparatus comprising:

a hollow, cylindrical mounting shank extending along a longitudinal axis, the mounting shank defining a first fluid passageway and including a valve seat;

a valve at least partially disposed within the mounting shank, the valve having an open position and a closed position, the valve including a valve pin and a valve seal supported by the valve pin, the valve seal biased against the valve seat in the closed position;

a fluid discharge control including:

a central body extending along the longitudinal axis and at least partially disposed within the mounting shank, wherein the central body includes a second fluid passageway, a sprayface supported by a first end of the central body and including at least one outlet in fluid communication with the second fluid passageway, and a depressible trigger operably coupled to the central body, the trigger moveable between a rest position and a depressed position;

a drain bowl operably coupled to the mounting shank, the drain bowl defined by a base and an upwardly extending wall including a first end and a second end;

a drain channel extending through the upwardly extending wall and defining a water delivery edge, the water delivery edge being disposed upstream relative to the first end and the second end of the upwardly extending wall; and wherein in the installed condition of the rinsing apparatus, the drain bowl is positioned above the mounting deck, the water delivery edge of the drain channel is positioned above the sink basin, the drain channel is configured to receive fluid from the drain bowl, and the water delivery edge is configured to discharge fluid above and into the sink basin.

15. The rinsing apparatus of claim 14, wherein:

the trigger is biased toward the rest position;

depressing the trigger is configured to move the valve pin such that the valve seal moves away from the valve seat causing the valve to be in the open position; and in the open position, the first fluid passageway of the mounting shank is in fluid communication with the second fluid passageway of the central body and the at least one outlet of the sprayface.

16. The rinsing apparatus of claim 14, wherein:

the valve pin defines a third fluid passageway; and fluid is configured to flow from the first fluid passageway of the mounting shank to the second fluid passageway of the central body through the third fluid passageway of the valve pin when the valve is in the open position.

17. The rinsing apparatus of claim 14, wherein the at least one outlet of the sprayface includes a first outlet configured to discharge fluid at a first angle relative to the longitudinal axis, and a second outlet configured to discharge fluid at a second angle relative to the longitudinal axis.

18. The rinsing apparatus of claim 14, wherein the base of the drain bowl includes an opening through which at least a portion of the mounting shank extends.

19. The rinsing apparatus of claim 14, wherein the fluid discharge control is in selective fluid communication with an outlet of a faucet mixing valve.

20. The rinsing apparatus of claim 14, wherein the trigger of the fluid discharge control includes a plurality of arms extending radially outwardly from the central body.

* * * * *